US010407748B2

(12) United States Patent
Takeda et al.

(10) Patent No.: US 10,407,748 B2
(45) Date of Patent: Sep. 10, 2019

(54) HIGH-CARBON STEEL SHEET AND METHOD OF MANUFACTURING THE SAME

(71) Applicant: NIPPON STEEL & SUMITOMO METAL CORPORATION, Tokyo (JP)

(72) Inventors: Kengo Takeda, Tokyo (JP); Toshimasa Tomokiyo, Tokyo (JP); Yasushi Tsukano, Tokyo (JP); Takashi Aramaki, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 688 days.

(21) Appl. No.: 15/038,120

(22) PCT Filed: Nov. 21, 2014

(86) PCT No.: PCT/JP2014/080951
§ 371 (c)(1),
(2) Date: May 20, 2016

(87) PCT Pub. No.: WO2015/076384
PCT Pub. Date: May 28, 2015

(65) Prior Publication Data

US 2016/0289787 A1 Oct. 6, 2016

(30) Foreign Application Priority Data

Nov. 22, 2013 (JP) ..... 2013-242060

(51) Int. Cl.
*C21D 9/46* (2006.01)
*C21D 8/02* (2006.01)
(Continued)

(52) U.S. Cl.
CPC ..... *C21D 9/46* (2013.01); *C21D 8/0226* (2013.01); *C21D 8/0236* (2013.01);
(Continued)

(58) Field of Classification Search
CPC ..... C21D 9/46; C21D 8/0226; C21D 8/0236; C21D 8/0263; C21D 8/0273; C21D 38/00;
(Continued)

(56) References Cited

U.S. PATENT DOCUMENTS 7,896,985 B2 * 3/2011 Arai ..... C22C 38/001 148/593
8,177,925 B2 * 5/2012 Takahashi ..... C21D 8/0226 148/320
(Continued)

FOREIGN PATENT DOCUMENTS

EP 1 865 079 A1 12/2007
EP 2 000 552 A2 12/2008
(Continued)

OTHER PUBLICATIONS

Extended European Search Report dated May 8, 2017 in European Patent Application No. 14864044.4.
(Continued)

*Primary Examiner* — Cam N. Nguyen
(74) *Attorney, Agent, or Firm* — Birch, Stewart, Kolasch & Birch, LLP

(57) ABSTRACT

A high-carbon steel sheet has a chemical composition represented by, in mass %, C: 0.60% to 0.90%, Mn: 0.30% to 1.50%, and Cr: 0.20% to 1.00%, and others, and has a structure represented by a concentration of Mn contained in cementite: 2% or more and 8% or less, a concentration of Cr contained in cementite: 2% or more and 8% or less, an average grain diameter of ferrite: 10 μm or more and 50 μm or less, an average particle diameter of cementite: 0.3 μm or more and 1.5 μm or less, and a spheroidized ratio of cementite: 85% or more.

4 Claims, 6 Drawing Sheets

(51) Int. Cl.

| | |
|---|---|
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/18*** | (2006.01) |
| ***C22C 38/28*** | (2006.01) |

(52) U.S. Cl.
CPC ..... *C21D 8/0263* (2013.01); *C21D 8/0273* (2013.01); *C22C 38/00* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/18* (2013.01); *C22C 38/28* (2013.01); *C21D 2211/003* (2013.01); *C21D 2211/005* (2013.01)

(58) Field of Classification Search
CPC .. C21D 38/001; C21D 38/002; C21D 38/005; C21D 38/02; C21D 38/04; C21D 38/06; C21D 38/18; C21D 38/28
See application file for complete search history.

(56) References Cited

U.S. PATENT DOCUMENTS

| | | | | |
|---|---|---|---|---|
| 8,470,099 | B2 * | 6/2013 | Yamasaki | C22C 38/10 148/320 |
| 8,845,825 | B2 * | 9/2014 | Hashimura | C21D 9/52 148/206 |
| 9,212,405 | B2 * | 12/2015 | Yamasaki | C21D 8/06 |
| 9,644,372 | B2 * | 5/2017 | Ichikawa | C22C 38/14 |
| 9,938,599 | B2 * | 4/2018 | Ueda | C22C 38/00 |
| 2004/0256029 | A1 | 12/2004 | Takayama et al. | |
| 2006/0021679 | A1 | 2/2006 | Takayama et al. | |
| 2011/0259483 | A1 | 10/2011 | Lee et al. | |
| 2015/0090376 | A1 | 4/2015 | Nakamura et al. | |

FOREIGN PATENT DOCUMENTS

| | | | |
|---|---|---|---|
| EP | 2 000 552 | A9 | 12/2008 |
| GB | 2 306 506 | A | 5/1997 |
| JP | 2-101122 | A | 4/1990 |
| JP | 2002-275584 | A | 9/2002 |
| JP | 2004-292945 | A | 10/2004 |
| JP | 2006-274348 | A | 10/2006 |
| JP | 2007-16284 | A | 1/2007 |
| JP | 2009-68081 | A | 4/2009 |
| JP | 2009-108354 | A | 5/2009 |
| JP | 2009-299189 | A | 12/2009 |
| JP | 2011-12316 | A | 1/2011 |
| JP | 2011-12317 | A | 1/2011 |
| JP | 2013-72105 | A | 4/2013 |
| JP | 5660220 | B2 | 1/2015 |
| TW | 201313921 | A | 4/2013 |
| TW | 201337002 | A | 9/2013 |
| WO | WO 2013/035848 | A1 | 3/2013 |

OTHER PUBLICATIONS

International Preliminary Report on Patentability and English Translation of the Written Opinion of the International Searching Authority (Forms PCT/IB/338, PCT/IB/373, and PCT/ISA/237) for International Application No. PCT/JP2014/080951, dated Jun. 2, 2016.
Korean Office Action dated Apr. 14, 2017, issued in corresponding Korean Patent Application No. 10-2016-7013105.
International Search Report for PCT/JP2014/080951 dated Feb. 24, 2015.
Written Opinion of the International Searching Authority for PCT/JP2014/080951 (PCT/ISA/237) dated Feb. 24, 2015.

* cited by examiner

HIGH-CARBON STEEL SHEET AND METHOD OF MANUFACTURING THE SAME

TECHNICAL FIELD

The present invention relates to a high-carbon steel sheet having an improved fatigue characteristic after quenching and tempering and a method of manufacturing the same.

BACKGROUND ART

A high-carbon steel sheet is used for automobile drive-line components, such as chains, gears and clutches. When an automobile drive-line component is manufactured, cold-working as shaping and quenching and tempering are performed of the high-carbon steel sheet. Weight reduction of automobile is currently in progress, and for drive-line components, weight reduction by strength enhancement is also considered. For example, to achieve strength enhancement of parts such as drive-line components undergone quenching and tempering, adding carbide-forming elements represented by Ti, Nb, Mo or increasing the content of C is effective.

Patent Literature 1 describes a method of manufacturing a mechanical structural steel intended for achieving both high hardness and high toughness, Patent Document 2 describes a method of manufacturing a rough-formed bearing intended for omission of spheroidizing, or the like, and Patent Literatures 3 and 4 describe methods of a manufacturing high-carbon steel sheet intended for improvement of punching property. Patent Literature 5 describes a medium-carbon steel sheet intended for improvement of cold workability and quenching stability, Patent Literature 6 describes a steel material for bearing element part intended for improvement of machinability, Patent Literature 7 describes a method of manufacturing a tool steel intended for omission of normalizing, and Patent Literature 8 describes a method of manufacturing a high-carbon steel sheet intended for improvement of formability.

On the other hand, the high-carbon steel sheet is required to have a good fatigue property, for example, a rolling contact fatigue property after quenching and tempering. However, the conventional manufacturing methods described in Patent Literatures 1 to 8 cannot achieve a sufficient fatigue property.

CITATION LIST

Patent Literature

Patent Literature 1: Japanese Laid-open Patent Publication No. 2013-072105

Patent Literature 2: Japanese Laid-open Patent Publication No. 2009-108354

Patent Literature 3: Japanese Laid-open Patent Publication No. 2011-012317

Patent Literature 4: Japanese Laid-open Patent Publication No. 2011-012316

Patent Literature 5: International Publication Pamphlet No. WO2013/035848

Patent Literature 6: Japanese Laid-open Patent Publication No. 2002-275584

Patent Literature 7: Japanese Laid-open Patent Publication No. 2007-16284

Patent Literature 8: Japanese Laid-open Patent Publication No. 2-101122

SUMMARY OF INVENTION

Technical Problem

It is an object of the present invention to provide a high-carbon steel sheet capable of achieving an excellent fatigue property after quenching and tempering and a method of manufacturing the same.

Solution to Problem

The present inventors carried out dedicated studies to determine the cause of that a good fatigue property is not obtained in a conventional high-carbon steel sheet after cold-working and quenching and tempering. Consequently, it was found that during the cold-working a crack and/or a void (hereinafter the crack and the void may be collectively referred to as a "void") occurs in cementite and/or iron-carbon compound (hereinafter the cementite and the iron-carbon compound may be collectively referred to as "cementite"), thereby decreasing formability and causing a crack to develop from the void. Further, it was also found that, while the cementite exists in ferrite grains and ferrite grain boundaries, a void occurs much more easily in cementite in a ferrite grain boundary than in cementite in a ferrite grain.

The present inventors further carried out dedicated studies to solve the above causes, and consequently found that the fatigue property can be improved significantly by setting the amounts of Mn and Cr contained in cementite to appropriate ranges and setting the size of ferrite to an appropriate range. In the conventional manufacturing methods described in Patent Literatures 1 to 8, these matters were not considered, and thus a sufficient fatigue property cannot be obtained. Moreover, it was also found that, in order to manufacture such a high-carbon steel sheet, it is important to set conditions of hot-rolling, cold-rolling and annealing to predetermined conditions while assuming these rolling and annealing as what is called a continuous process. Then, based on these findings, the present inventors have devised the following various embodiments of the invention. Note that the "cementite" in the present specification and claims means cementite and iron-carbon compound which are not contained in pearlite and are distinguished from pearlite, except in any part where it is clarified as a concept including cementite contained in pearlite.

(1) A high-carbon steel sheet including a chemical composition represented by, in mass %:

C: 0.60% to 0.90%;
Si: 0.10% to 0.40%;
Mn: 0.30% to 1.50%;
N: 0.0010% to 0.0100%;
Cr: 0.20% to 1.00%;
P: 0.0200% or less;
S: 0.0060% or less;
Al: 0.050% or less;
Mg: 0.000% to 0.010%;
Ca: 0.000% to 0.010%;
Y: 0.000% to 0.010%;
Zr: 0.000% to 0.010%;
La: 0.000% to 0.010%;
Ce: 0.000% to 0.010%; and
balance: Fe and impurities; and
a structure represented by:
a concentration of Mn contained in cementite: 2% or more and 8% or less, a concentration of Cr contained in cementite: 2% or more and 8% or less, an average grain diameter of ferrite: 10 μm or more and 50 μm or less, an average particle diameter of cementite: 0.3 μm or more and 1.5 μm or less, and a spheroidized ratio of cementite: 85% or more.

(2) The high-carbon steel sheet according to (1), wherein in the chemical composition, Mg: 0.001% to 0.010%, Ca: 0.001% to 0.010%, Y: 0.001% to 0.010%, Zr: 0.001% to 0.010%, La: 0.001% to 0.010%, or Ce: 0.001% to 0.010%, or any combination thereof is satisfied.

(3) A method of manufacturing a high-carbon steel sheet, including:

hot-rolling of a slab to obtain a hot-rolled sheet;

pickling of the hot-rolled sheet;

annealing of the hot-rolled sheet after the pickling to obtain a hot-rolled annealed sheet;

cold-rolling of the hot-rolled annealed sheet to obtain a cold-rolled sheet; and annealing of the cold-rolled sheet, wherein the slab has a chemical composition represented by, in mass %:

C: 0.60% to 0.90%;

Si: 0.10% to 0.40%;

Mn: 0.30% to 1.50%;

P: 0.0200% or less;

S: 0.0060% or less;

Al: 0.050% or less;

N: 0.0010% to 0.0100%;

Cr: 0.20% to 1.00%;

Mg: 0.000% to 0.010%;

Ca: 0.000% to 0.010%;

Y: 0.000% to 0.010%;

Zr: 0.000% to 0.010%;

La: 0.000% to 0.010%;

Ce: 0.000% to 0.010%; and balance: Fe and impurities, and in the hot-rolling, a finishing temperature of finish-rolling is 800° C. or more and less than 950° C., and a coiling temperature is 450° C. or more and less than 550° C., a reduction ratio in the cold-rolling is 5% or more and 35% or less, annealing of the hot-rolled sheet includes:

heating the hot-rolled sheet to a first temperature of 450° C. or more and 550° C. or less, a heating rate from 60° C. to the first temperature being 30° C./hour or more and 150° C./hour or less;

then holding the hot-rolled sheet at the first temperature for one hour or more and less than 10 hours;

then heating the hot-rolled sheet at a heating rate of 5° C./hour or more and 80° C./hour or less from the first temperature to a second temperature of 670° C. or more and 730° C. or less; and then holding the hot-rolled sheet at the second temperature for 20 hours or more and 200 hours or less, the annealing of the cold-rolled sheet includes:

heating the cold-rolled sheet to a third temperature of 450° C. or more and 550° C. or less, a heating rate from 60° C. to the third temperature is 30° C./hour or more and 150° C./hour or less;

then holding the cold-rolled sheet at the third temperature for one hour or more and less than 10 hours;

then heating the cold-rolled sheet at a heating rate of 5° C./hour or more and 80° C./hour or less from the third temperature to a fourth temperature of 670° C. or more and 730° C. or less; and then holding the cold-rolled sheet at the fourth temperature for 20 hours or more and 200 hours or less.

(4) The method of manufacturing the high-carbon steel sheet according to (3), wherein in the chemical composition, Mg: 0.001% to 0.010%, Ca: 0.001% to 0.010%, Y: 0.001% to 0.010%, Zr: 0.001% to 0.010%, La: 0.001% to 0.010%, or Ce: 0.001% to 0.010%, or any combination thereof is satisfied.

Advantageous Effects of Invention

According to the present invention, concentrations of Mn and Cr contained in cementite and so on are appropriate, and thus a fatigue property after quenching and tempering can be improved.

DESCRIPTION OF EMBODIMENTS

Figure 1:
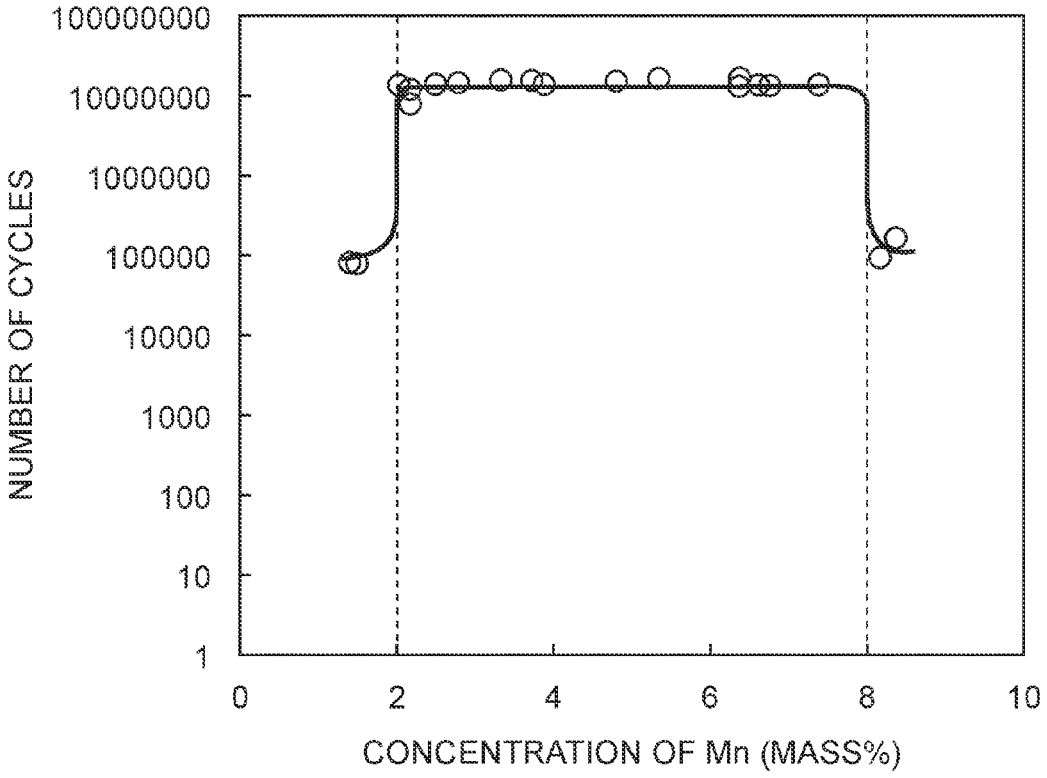
FIG. 1 is a chart illustrating a relationship between a concentration of Mn contained in cementite and a rolling contact fatigue property.

Hereinafter, embodiments of the present invention will be described.

First, chemical compositions of a high-carbon steel sheet according to an embodiment of the present invention and a slab (steel ingot) used for manufacturing the same will be described. Although details will be described later, the high-carbon steel sheet according to the embodiment of the present invention is manufactured through cold-rolling of the slab, hot-rolled sheet annealing, cold-rolling, annealing of cold-rolled sheet, and so on. Therefore, the chemical compositions of the high-carbon steel sheet and the slab are ones in consideration of not only properties of the high-carbon steel sheet but these processes. In the following description, "%" which is a unit of content of each element contained in the high-carbon steel sheet and the slab used for manufacturing the same means "mass %" unless otherwise specified. The high-carbon steel sheet according to this embodiment and the slab used for manufacturing the same have a chemical composition represented by C: 0.60% to 0.90%, Si: 0.10% to 0.40%, Mn: 0.30% to 1.50%, N: 0.0010% to 0.0100%, Cr: 0.20% to 1.00%, P: 0.0200% or less, S: 0.0060% or less, Al: 0.050% or less, Mg: 0.000% to 0.010%, Ca: 0.000% to 0.010%, Y: 0.000% to 0.010%, Zr: 0.000% to 0.010%, La: 0.000% to 0.010%, Ce: 0.000% to 0.010%, and balance: Fe and impurities. As the impurities, impurities contained in raw materials, such as ore and scrap, and impurities mixed in during a manufacturing process are exemplified. For example, when scrap is used as a raw material, Sn, Sb or As or any combination thereof may be mixed in by 0.001% or more. However, when the content is 0.02% or less, none of them hinder the effect of this embodiment, and hence may be tolerated as impurities. O may be tolerated as an impurity up to 0.004%. O forms an oxide, and when oxides aggregate and become coarse, sufficient formability cannot be obtained. Thus, the O content is the lower the better, but it is technically difficult to decrease the O content to less than 0.0001%. Examples of the impurities also include Ti: 0.04% or less, V: 0.04% or less, Cu: 0.04% or less, W: 0.04% or less, Ta: 0.04% or less, Ni: 0.04% or less, Mo: 0.04% or less, B: 0.01% or less, and Nb: 0.04% or less. The amount of these elements contained is preferred to be as small as possible, but it is technically difficult to decrease them to less than 0.001%.

(C: 0.60% to 0.90%)

C is an effective element for strength enhancement of steel, and is particularly an element that increases a quenching property. C is also an element that contributes to improvement of fatigue property after quenching and tempering. When the C content is less than 0.60%, pro-eutectoid ferrite or pearlite is formed in a prior austenite grain boundary during quenching, resulting in a decrease in fatigue property after quenching and tempering. Therefore, the C content is 0.060% or more, preferably 0.65% or more. When the C content is more than 0.90%, a large amount of retained austenite exists after quenching. The retained austenite is decomposed into ferrite and cementite during tempering, and a large strength difference occurs between the tempered martensite or bainite and the ferrite and cementite formed by decomposition of the retained austenite after tempering, resulting in a decrease in fatigue property after quenching and tempering. Therefore, the C content is 0.90% or less, preferably 0.85% or less.

(Si: 0.10% to 0.40%)

Si operates as a deoxidizer, and is also an effective element for improvement of fatigue property after quenching and tempering. When the Si content is less than 0.10%, the effect by the above operation cannot be obtained sufficiently. Therefore, the Si content is 0.10% or more, preferably 0.15% or more. When the Si content is more than 0.40%, the amount and the size of Si oxides formed as inclusions in steel increase, and the fatigue property after quenching and tempering decreases. Therefore, the Si content is 0.40% or less, preferably 0.35% or less.

(Mn: 0.30% to 1.50%)

Mn is an element contained in cementite and suppressing generation of void during cold-working. When the Mn content is less than 0.30%, annealing for causing cementite to contain a sufficient amount of Mn takes a very long time, which significantly decreases productivity. Therefore, the Mn content is 0.30% or more, preferably 0.50% or more. When the Mn content is more than 1.50%, Mn contained in cementite becomes excessive, making cementite difficult to dissolve during heating for quenching, resulting in an insufficient amount of C solid-dissolved in austenite. Consequently, the strength after quenching decreases, and the fatigue property after quenching and tempering also decreases. Therefore, the Mn content is 1.50% or less, preferably 1.30% or less.

(N: 0.001 to 0.010%)

N is combined with Al to generate AlN, and is an effective element for grain refinement of austenite during heating for quenching. When the N content is less than 0.001%, the effect by the above operation cannot be obtained sufficiently. Therefore, the N content is 0.001% or more, preferably 0.002% or more. When the N content is more than 0.010%, austenite grains become excessively small, which decreases the quenching property and facilitates generation of pro-eutectoid ferrite and pearlite during cooling of quenching, resulting in a decrease in fatigue property after quenching and tempering. Therefore, the N content is 0.010% or less, preferably 0.008% or less.

(Cr: 0.20% to 1.00%)

Cr is an element contained in cementite and suppressing generation of void during cold-working, similarly to Mn. When the Cr content is less than 0.20%, annealing for causing cementite to contain a sufficient amount of Cr takes a very long time, which significantly decreases productivity. Therefore, the Cr content is 0.20% or more, preferably 0.35% or more. When the Cr content is more than 1.00%, Cr contained in cementite becomes excessive, making cementite difficult to dissolve during heating for quenching, resulting in an insufficient amount of C solid-dissolved in austenite. Consequently, the strength after quenching decreases, and the fatigue property after quenching and tempering also decreases. Therefore, the Cr content is 1.00% or less, preferably 0.85% or less.

(P: 0.0200% or less)

P is not an essential element and is contained as, for example, an impurity in steel. P is an element which decreases the fatigue property after quenching and tempering, and/or decreases toughness after quenching. For example, when toughness decreases, a crack easily occurs after quenching. Thus, the P content is the smaller the better. In particular, when the P content is more than 0.0200%, adverse effects become prominent. Therefore, the P content is 0.0200% or less, preferably 0.0180% or less. Decreasing the P content takes time and cost, and when it is attempted to decrease it to less than 0.0001%, the time and cost increase significantly. Thus, the P content may be 0.0001% or more, or may be 0.0010% or more for further reduction in time and cost.

(S: 0.0060% or less)

S is not an essential element and is contained as, for example, an impurity in steel. S is an element forming a sulfide such as MnS, and decreasing the fatigue property after quenching and tempering. Thus, the S content is smaller the better. In particular, when the S content is more than 0.0060%, adverse effects become prominent. Therefore, the S content is 0.0060% or less. Decreasing the S content takes time and cost, and when it is attempted to decrease it to less than 0.0001%, the time and cost increase significantly. Thus, the S content may be 0.0001% or more.

(Al: 0.050% or less)

Al is an element which operates as a deoxidizer at the stage of steelmaking, but is not an essential element of the high-carbon steel sheet and is contained as, for example, an impurity in steel. When the Al content is more than 0.050%, a coarse Al oxide is formed in the high-carbon steel sheet, resulting in a decrease in fatigue property after quenching and tempering. Therefore, the Al content is 0.050% or less. When the Al content of the high-carbon steel sheet is less than 0.001%, it is possible that deoxidation is insufficient. Therefore, the Al content may be 0.001% or more.

Mg, Ca, Y, Zr, La and Ce are not essential elements, and are optional elements which may be appropriately contained in the high-carbon steel sheet and the slab up to a predetermined amount.

(Mg: 0.000% to 0.010%)

Mg is an effective element for controlling the form of sulfide, and is an effective element for improvement of fatigue property after quenching and tempering. Thus, Mg may be contained. However, when the Mg content is more than 0.010%, a coarse Mg oxide is formed, and the fatigue property after quenching and tempering decreases. Therefore, the Mg content is 0.010% or less, preferably 0.007% or less. In order to reliably obtain the effect by the above operation, the Mg content is preferably 0.001% or more.

(Ca: 0.000% to 0.010%)

Ca is an effective element for controlling the form of sulfide, and is an effective element for improvement of fatigue property after quenching and tempering, similarly to Mg. Thus, Ca may be contained. However, when the Ca content is more than 0.010%, a coarse Ca oxide is formed, and the fatigue property after quenching and tempering decreases. Therefore, the Ca content is 0.010% or less, preferably 0.007% or less. In order to reliably obtain the effect by the above operation, the Ca content is preferably 0.001% or more.

(Y: 0.000% to 0.010%)

Y is an effective element for controlling the form of sulfide, and is an effective element for improvement of fatigue property after quenching and tempering, similarly to Mg and Ca. Thus, Y may be contained. However, when the Y content is more than 0.010%, a coarse Y oxide is formed, and the fatigue property after quenching and tempering decreases. Therefore, the Y content is 0.010% or less, preferably 0.007% or less. In order to reliably obtain the effect by the above operation, the Y content is preferably 0.001% or more.

(Zr: 0.000% to 0.010%)

Zr is an effective element for controlling the form of sulfide, and is an effective element for improvement of fatigue property after quenching and tempering, similarly to Mg, Ca and Y. Thus, Zr may be contained. However, when the Zr content is more than 0.010%, a coarse Zr oxide is formed, and the fatigue property after quenching and tempering decreases. Therefore, the Zr content is 0.010% or less, preferably 0.007% or less. In order to reliably obtain the effect by the above operation, the Zr content is preferably 0.001% or more.

(La: 0.000% to 0.010%)

La is an effective element for controlling the form of sulfide, and is an effective element for improvement of fatigue property after quenching and tempering, similarly to Mg, Ca, Y and Zr. Thus, La may be contained. However, when the La content is more than 0.010%, a coarse La oxide is formed, and the fatigue property after quenching and tempering decreases. Therefore, the La content is 0.010% or less, preferably 0.007% or less. In order to reliably obtain the effect by the above operation, the La content is preferably 0.001% or more.

(Ce: 0.000% to 0.010%)

Ce is an effective element for controlling the form of sulfide, and is an effective element for improvement of fatigue property after quenching and tempering, similarly to Mg, Ca, Y and Zr. Thus, Ce may be contained. However, when the Ce content is more than 0.010%, a coarse Ce oxide is formed, and the fatigue property after quenching and tempering decreases. Therefore, the Ce content is 0.010% or less, preferably 0.007% or less. In order to reliably obtain the effect by the above operation, the Ce content is preferably 0.001% or more.

Thus, Mg, Ca, Y, Zr, La and Ce are optional elements, and it is preferred that "Mg: 0.001% to 0.010%", "Ca: 0.001% to 0.010%", "Y: 0.001% to 0.010%", "Zr: 0.001% to 0.010%", "La: 0.001% to 0.010%", or "Ce: 0.001% to 0.010%", or any combination thereof be satisfied.

Next, the structure of the high-carbon steel sheet according to this embodiment will be described. The high-carbon steel sheet according to this embodiment has a structure represented by a concentration of Mn contained in cementite: 2% or more and 8% or less, a concentration of Cr contained in cementite: 2% or more and 8% or less, an average grain diameter of ferrite: 10 μm or more and 50 μm or less, an average particle diameter of cementite particles: 0.3 μm or more and 1.5 μm or less, and a spheroidized ratio of cementite particles: 85% or more.

(Concentration of Mn and Concentration of Cr Contained in Cementite: Both 2% or More and 8% or Less)

Although details will be described later, Mn and Cr contained in cementite contribute to suppression of generation of void in cementite during cold-working. The suppression of generation of void during cold-working improves the fatigue property after quenching and tempering. When the concentration of Mn or Cr contained in cementite is less than 2%, the effect by the above operation cannot be obtained sufficiently. Therefore, the concentration of Mn and the concentration of Cr contained in cementite are 2% or more. When the concentration of Mn or Cr contained in cementite is more than 8%, solid-dissolvability of C from cementite to austenite during heating for quenching decreases, the quenching property decreases, and a structure with low strength compared to pro-eutectoid ferrite, pearlite, quenched martensite or bainite disperses. As a result, the fatigue property after quenching and tempering decreases. Therefore, the concentration of Mn and the concentration of Cr contained in cementite is 8% or less.

Here, a study carried out by the present inventors on the relationship between the concentration of Mn contained in cementite and the fatigue property will be described.

In this study, high-carbon steel sheets were manufactured through hot-rolling, hot-rolled sheet annealing, cold-rolling and cold-rolled sheet annealing under various conditions. Then, with respect to each high-carbon steel sheet, the concentration of Mn and the concentration of Cr contained in cementite were measured by using an electron probe micro-analyzer (FE-EPMA) equipped with a field-emission electron gun made by Japan Electron Optics Laboratory. Next, the high-carbon steel sheet was subjected to cold-rolling with a reduction ratio of 35% simulating cold-working (shaping), and the high-carbon steel sheet was held for 20 minutes in a salt bath heated to 900° C. and quenched in oil at 80° C. Subsequently, the high-carbon steel sheet was subjected to tempering by holding for 60 minutes in an atmosphere at 180° C., thereby producing a sample for fatigue test.

Thereafter, a fatigue test was performed, and void in cementite after cold-working was observed. In the fatigue test, a rolling contact fatigue tester was used, the surface pressure was set to 3000 MPa, and the number of cycles until peeling occurs was counted. In the observation of void, a scanning electron microscope (FE-SEM) equipped with a field-emission electron gun made by Japan Electron Optics Laboratory was used, and the structure of a region having an area of 1200 $\mu m^2$ was photographed at magnification of about 3000 times at 20 locations at equal intervals in a thickness direction of the high-carbon steel sheet. Then, the number of voids generated by cracking of cementite (hereinafter may also be simply referred to as "the number of voids") was counted in a region having an area of 24000 $\mu m^2$ in total, and the total number of these voids was divided by 12 to calculate the number of voids per 2000 $\mu m^2$. In this embodiment, the average particle diameter of cementite is 0.3 μm or more and 1.5 μm or less, and thus the magnification for the observation thereof is preferably 3000 times or more, or even a higher magnification such as 5000 times or 10000 times may be chosen depending on the size of cementite. Even when the magnification is more than 3000 times, the number of voids per unit area (for example, per 2000 $\mu m^2$) is equal to that when it is 3000 times. Voids may also exist in the interface between cementite and ferrite, but the influence of such voids on the fatigue property is quite small as compared to the influence of voids generated by cracking of cementite. Thus, such voids are not counted.

The sample subjected to measurement using FE-EPMA or FE-SEM was prepared as follows. First, an observation surface was mirror polished by buffing with a wet emery paper and diamond abrasive particles, and then dipped for 20 seconds at room temperature (20° C.) in a picral (saturated picric acid-3 vol % of nitric acid-alcohol) solution, so as to let the structure appear. Thereafter, moisture on the observation surface was removed with a hot air dryer and the like, and then the sample was carried into a specimen exchange chamber of the FE-EPMA and the FE-SEM within three hours in order to prevent contamination.

Figure 2:
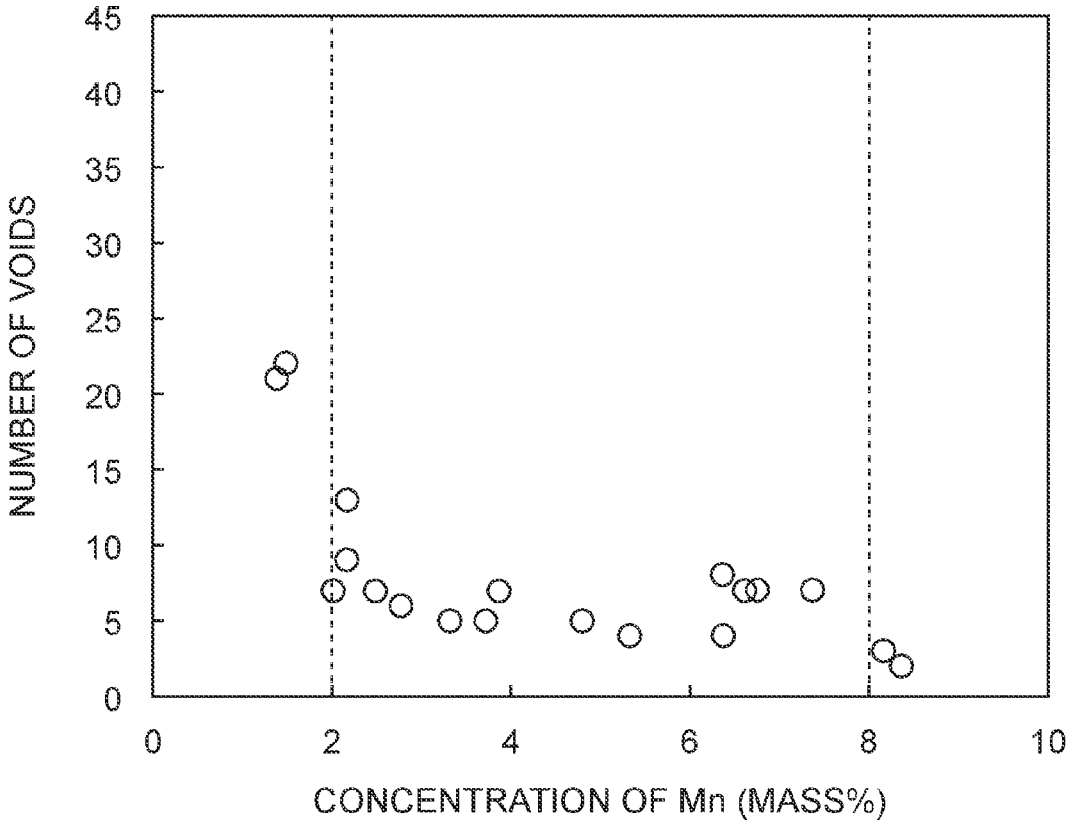
FIG. 2 is a chart illustrating a relationship between the concentration of Mn in cementite and a number of voids by crack of cementite.
Figure 3:
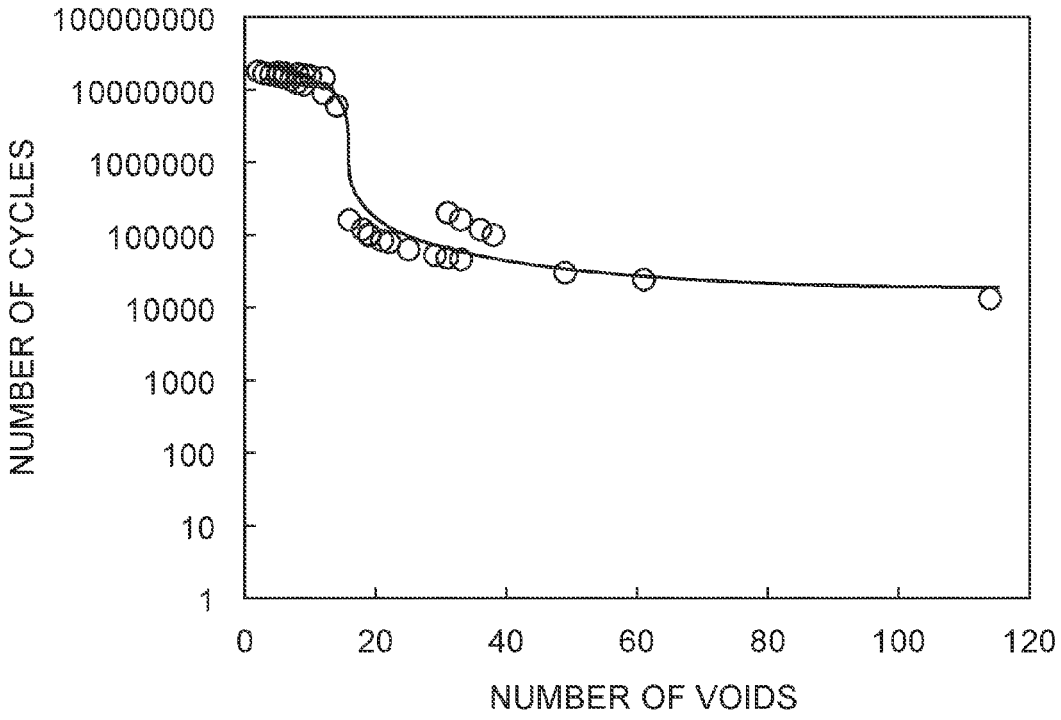
FIG. 3 is a chart illustrating a relationship between a number of voids by crack of cementite and the rolling contact fatigue property.

Their results are illustrated in FIG. 1, FIG. 2 and FIG. 3. FIG. 1 is a chart illustrating a relationship between a concentration of Mn contained in cementite and a rolling contact fatigue property. FIG. 2 is a chart illustrating a relationship between a concentration of Mn contained in cementite and the number of voids. FIG. 3 is a chart illustrating a relationship between the number of voids and the rolling contact fatigue property. The results illustrated in FIG. 1 to FIG. 3 are of samples in which the concentration of Or contained in cementite is 2% or more and 8% or less.

From FIG. 1, it can be seen that the rolling contact fatigue property is significantly high when the concentration of Mn contained in cementite is in the range of 2% or more and 8% or less. From FIG. 2, it can be seen that generation of voids is suppressed when the concentration of Mn contained in cementite is in the range of 2% or more and 8% or less. From FIG. 3, it can be seen that the fatigue property is quite high in the case where the number of voids per 2000 $\mu m^2$ is 15 or less, as compared to the case where it is more than 15. From the results illustrated in FIG. 1 to FIG. 3, it is conceivable that when the concentration of Mn contained in cementite is 2% or more and 8% or less, the cementite becomes less breakable during cold-working (shaping) and generation of voids is suppressed, and thus development of cracking at a void is suppressed in the fatigue test after subsequent quenching and tempering, resulting in an improvement of fatigue property.

Figure 4:
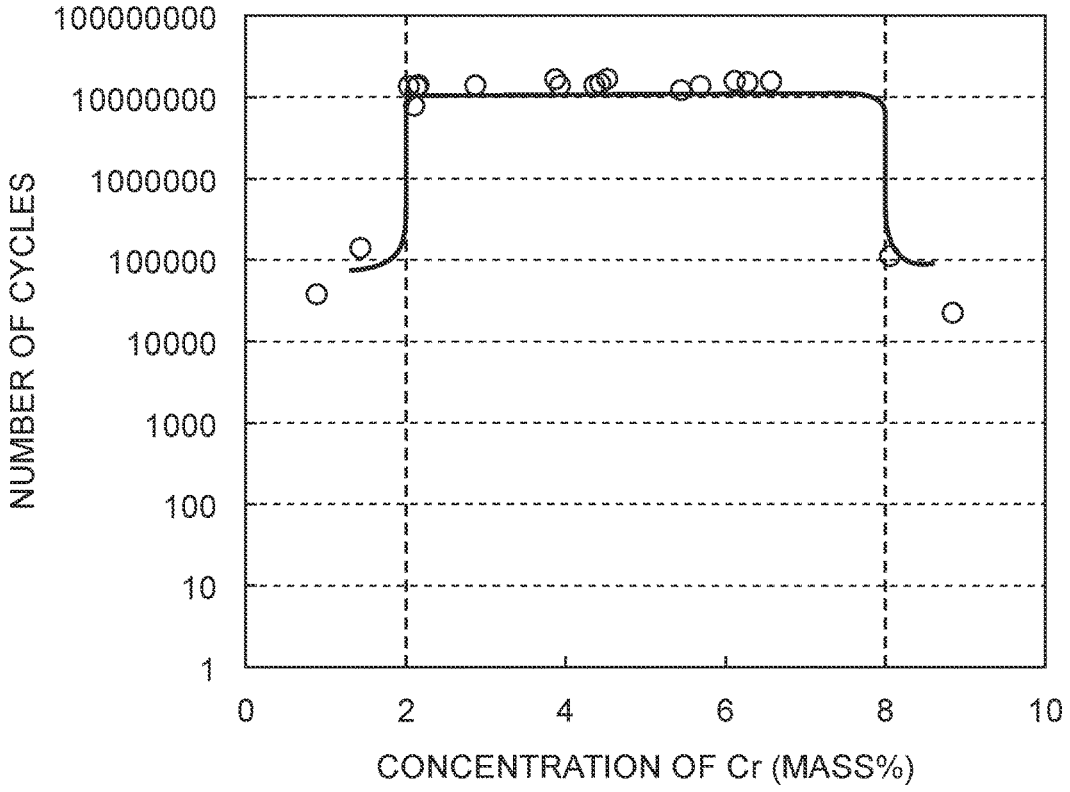
FIG. 4 is a chart illustrating a relationship between a concentration of Cr contained in cementite and the rolling contact fatigue property.
Figure 5:
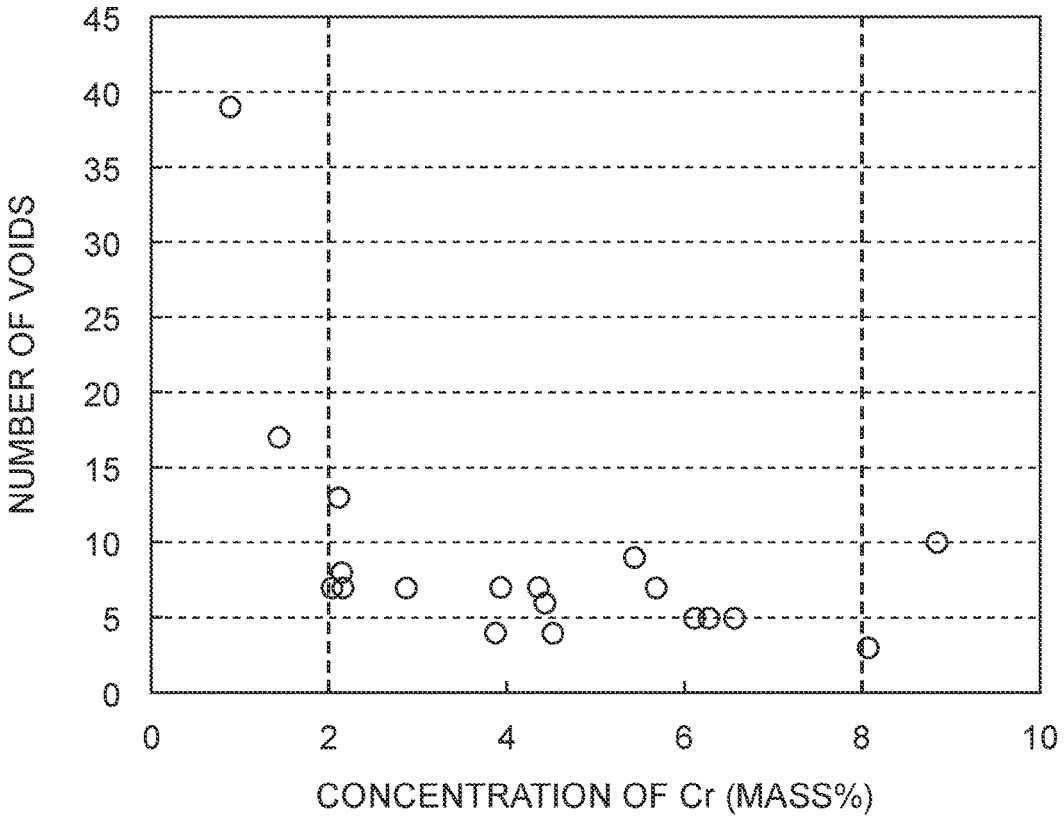
FIG. 5 is a chart illustrating a relationship between the concentration of Cr contained in cementite and a number of voids by crack of cementite.

The present inventors have also studied the relationship between the concentration of Cr contained in cementite and the rolling contact fatigue property and the number of voids. Their results are illustrated in FIG. 4 and FIG. 5. FIG. 4 is a chart illustrating a relationship between the concentration of Cr contained in cementite and the rolling contact fatigue property. FIG. 5 is a chart illustrating a relationship between the concentration of Cr contained in cementite and the number of voids. The results illustrated in FIG. 4 and FIG. 5 are of samples in which the concentration of Mn contained in cementite is 2% or more and 8% or less. As illustrated in FIG. 4 and FIG. 5, similarly to the relationship between the concentration of Mn contained in cementite and the rolling contact fatigue property or the number of voids illustrated in FIG. 1 and FIG. 2, it was found that an excellent rolling contact fatigue property is obtained when the concentration of Cr contained in cementite is 2% or more and 8% or less.

The reason why Mn and Cr contained in cementite contribute to suppression of generation of voids during cold-working is not clear, but it can be assumed that mechanical properties, such as tensile strength and ductility, of cementite are improved by Mn and Cr contained in cementite.

(Average Grain Diameter of Ferrite: 10 μm or More and 50 μm or Less)

The smaller the ferrite, the more the ferrite grain boundary area increases. When the average grain diameter of ferrite is less than 10 μm, generation of void during cold-working in cementite on the ferrite grain boundary becomes significant. Therefore, the average grain diameter of ferrite is 10 μm or more, preferably 12 μm or more. When the average grain diameter of ferrite is more than 50 μm, a matted surface is generated on a surface of the steel sheet after shaping, which disfigures the surface. Therefore, the average grain diameter of ferrite is 50 μm or less, preferably 45 μm or less.

The average grain diameter of ferrite can be measured by the FE-SEM after the above-described mirror-polishing and etching with a picral are performed. For example, an average area of 200 grains of ferrite is obtained, and the diameter of a circle with which this average area can be obtained is obtained, thereby taking this diameter as the average grain diameter of ferrite. The average area of ferrite is a value obtained by dividing the total area of ferrite by the number of ferrite, here 200.

(Average Particle Diameter of Cementite: 0.3 μm or More and 1.5 μm or Less)

The size of cementite largely influences the fatigue property after quenching and tempering. When the average particle diameter of cementite is less than 0.3 μm, the fatigue property after quenching and tempering decreases. Therefore, the average particle diameter of cementite is 0.3 μm or more, preferably 0.5 μm or more. When the average particle diameter of cementite is more than 1.5 μm, voids are generated dominantly in coarse cementite during cold-working, and the fatigue property after quenching and tempering decreases. Therefore, the average particle diameter of cementite is 1.5 μm or less, preferably 1.3 μm or less.

(Spheroidized Ratio of Cementite: 85% or More)

The lower the spheroidized ratio of cementite, the more the locations where a void is easily generated, for example acicular portions or the like, increase. When the spheroidized ratio of cementite is less than 85%, the void during cold-working in cementite is significantly generated. Therefore, the spheroidized ratio of cementite is 85% or more, preferably 90% or more. The spheroidized ratio of cementite is preferred to be as high as possible, but in order to make it 100%, the annealing takes a very long time, which increases the manufacturing cost. Therefore, in view of the manufacturing cost, the spheroidized ratio of cementite is preferably 99% or less, more preferably 98% or less.

The spheroidized ratio and the average particle diameter of cementite can be measured by micro structure observation with the FE-SEM. In production of a sample for micro structure observation, after the observation surface was mirror polished by wet polishing with an emery paper and polishing with diamond abrasive particles having a particle size of 1 μm, etching with the above-described picral solution is performed. The observation magnification is set between 1000 times to 10000 times, for example 3000 times, 16 visual fields where 500 or more particles of cementite are contained on the observation surface are selected, and a structure image of them is obtained. Then, the area of each cementite in the structure image is measured by using image processing software. As the image processing software, for example, "WinROOF" made by MITANI Corporation can be used. At this time, in order to suppress the influence of measurement error by noise, any cementite particle having an area of 0.01 $\mu m^2$ or less is excluded from the target of evaluation. Then, the average area of cementite as an evaluation target is obtained, and the diameter of a circle with which this average area can be obtained is obtained, thereby taking this diameter as the average particle diameter of cementite. The average area of cementite is a value obtained by dividing the total area of cementite as the evaluation target by the number of cementite. Further, any cementite particle having a ratio of major axis length to minor axis length of 3 or more is assumed as an acicular cementite particle, any cementite particle having the ratio of less than 3 is assumed as a spherical cementite particle, and a value obtained by dividing the number of spherical cementite particles by the number of all cementite particles is taken as the spheroidized ratio of cementite.

Next, a method of manufacturing the high-carbon steel sheet according to this embodiment will be described. This manufacturing method includes hot-rolling of a slab having the above chemical composition to obtain a hot-rolled sheet, pickling of this hot-rolled sheet, thereafter annealing of the hot-rolled sheet to obtain a hot-rolled annealed sheet, cold-rolling of the hot-rolled annealed sheet to obtain a cold-rolled sheet, and annealing of the cold-rolled sheet. In the hot-rolling, the finishing temperature of finish-rolling is 800° C. or more and less than 950° C., and the coiling temperature is 450° C. or more and less than 550° C. The reduction ratio in the cold-rolling is 5% or more and 35% or less. In the hot-rolled sheet annealing, the hot-rolled sheet is heated to a first temperature of 450° C. or more and 550° C. or less, then the hot-rolled sheet is held at the first temperature for one hour or more and less than 10 hours, then the hot-rolled sheet is heated at a heating rate of 5° C./hour or more and 80° C./hour or less from the first temperature to a second temperature of 670° C. or more and 730° C. or less, and then the hot-rolled sheet is held at the second temperature for 20 hours or more and 200 hours or less. When the hot-rolled sheet is heated to the first temperature, the heating rate from 60° C. to the first temperature is 30° C./hour or more and 150° C./hour or less. In the cold-rolled sheet annealing, the cold-rolled sheet is heated to a third temperature of 450° C. or more and 550° C. or less, then the cold-rolled sheet is held at the third temperature for one hour or more and less than 10 hours, then the cold-rolled sheet is heated at a heating rate of 5° C./hour or more and 80° C./hour or less from the third temperature to a fourth temperature of 670° C. or more and 730° C. or less, and then the cold-rolled sheet is held at the fourth temperature for 20 hours or more and 200 hours or less. When the cold-rolled sheet is heated to the third temperature, the heating rate from 60° C. to the third temperature is 30° C./hour or more and 150° C./hour or less. Both of the annealing of the hot-rolled sheet and the annealing of the cold-rolled sheet may be considered as including two-stage annealing.

(Finishing Temperature of the Finish-Rolling of Hot-Rolling: 800° C. or More and Less than 950° C.)

When the finishing temperature of the finish-rolling is less than 800° C., deformation resistance of the slab is high, the rolling load increases, the abrasion amount of the reduction roll increases, and productivity decreases. Therefore, the finishing temperature of the finish-rolling is 800° C. or more, preferably 810° C. or more. When the finishing temperature of the finish-rolling is 950° C. or more, scales are generated during the hot-rolling, and the scales are pressed against the slab by the reduction roll and thereby form scratches on a surface of the obtained hot-rolled sheet, resulting in a decrease in productivity. Therefore, the finishing temperature of the finish-rolling is less than 950° C., preferably 920° C. or less. The slab can be produced by continuous casting for example, and this slab may be subjected as it is to hot-rolling, or may be cooled once, and then heated and subjected to hot-rolling.

(Coiling Temperature of the Hot-Rolling: 450° C. or More and Less than 550° C.)

The coiling temperature is preferred to be as low as possible. However, when the coiling temperature is less than 450° C., embrittlement of the hot-rolled sheet is significant, and when the coil of the hot-rolled sheet is uncoiled for pickling, a crack or the like occurs in the hot-rolled sheet, resulting in a decrease in productivity. Therefore, the coiling temperature is 450° C. or more, preferably 470° C. or more. When the coiling temperature is 550° C. or more, the structure of the hot-rolled sheet does not become fine, and it becomes difficult for Mn and Cr to diffuse during the hot-rolled sheet annealing, making it difficult to make cementite contain a sufficient amount of Mn and/or Cr. Therefore, the coiling temperature is less than 550° C., preferably 530° C. or less.

(Reduction Ratio in the Cold-Rolling: 5% or More and 35% or Less)

If the reduction ratio in the cold-rolling is less than 5%, even when the cold-rolled sheet is annealed subsequently, a large amount of non-recrystallized ferrite remains thereafter. Thus, the structure after the cold-rolled sheet annealing becomes a non-uniform structure in which recrystallized parts and non-recrystallized parts are mixed, the distribution of strain generated inside the high-carbon steel sheet during the cold-working also becomes non-uniform, and voids are easily generated in cementite which is largely distorted. Therefore, the reduction ratio in the cold-rolling is 5% or more, preferably 10% or more. When the reduction ratio is more than 35%, nucleation rate of recrystallized ferrite increases, and the average grain diameter of ferrite cannot be 10 μm or more. Therefore, the reduction ratio in the cold-rolling is 35% or less, preferably 30% or less.

(First Temperature: 450° C. or More and 550° C. or Less)

In this embodiment, while the hot-rolled sheet is held at the first temperature, Mn and Cr are diffused into cementite, so as to increase the concentrations of Mn and Cr contained in cementite. When the first temperature is less than 450° C., the diffusion frequency of Fe as well as substitutional solid-dissolved elements such as Mn and Cr decreases, and it takes a long time for making cementite contain sufficient amounts of Mn and Cr, resulting in a decrease in productivity. Therefore, the first temperature is 450° C. or more, preferably 480° C. or more. When the first temperature is more than 550° C., it is not possible to make cementite contain sufficient amounts of Mn and Cr. Therefore, the first temperature is 550° C. or less, preferably 520° C. or less.

Figure 6:
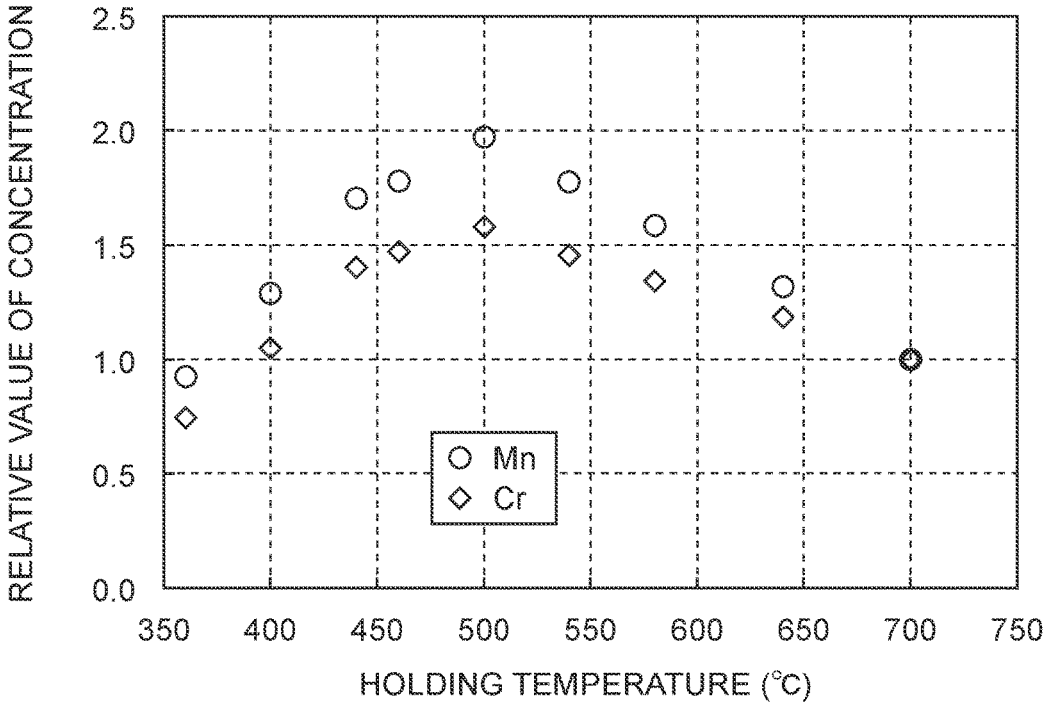
FIG. 6 is a chart illustrating a relationship between a holding temperature in hot-rolled sheet annealing and the concentrations of Mn and Cr contained in cementite.

Here, a study carried out by the present inventors on the relationship between the first temperature and the concentrations of Mn and Cr contained in cementite will be described. In this study, it was held for nine hours at various temperatures, and the concentrations of Mn and Cr contained in cementite were measured. Results of this are illustrated in FIG. 6. The vertical axis of FIG. 6 represents the ratios of the concentrations of Mn and Cr to values when the holding temperature is 700° C. From FIG. 6, it can be seen that both the concentrations of Mn and Cr become high particularly in the vicinity of 500° C.

(Holding Time at the First Temperature: One Hour or More and Less than 10 Hours)

The concentrations of Mn and Cr contained in cementite are closely related to the holding time at the first temperature. When this time is less than one hour, it is not possible to make cementite contain sufficient amounts of Mn and Cr. Therefore, this time is one hour or more, preferably 1.5 hours or more. When this time is more than 10 hours, increases of the concentrations of Mn and Cr contained in cementite become small, which takes time and cost in particular. Therefore, this time is 10 hours or less, preferably seven hours or less.

(Heating Rate from 60° C. to the First Temperature: 30° C./Hour or More and 150° C. or Less)

In the annealing of hot-rolled sheet, for example, it is heated from room temperature, and if the heating rate from 60° C. to the first temperature is less than 30° C./hour, it takes a long time to increase in temperature, resulting in a decrease in productivity. Therefore, this heating rate is 30° C./hour or more, preferably 60° C./hour or more. When this heating rate is more than 150° C./hour, the temperature difference between an inside portion and an outside portion of the coil of the hot-rolled sheet becomes large, and scratches and/or deformation of coiling shape occurs due to an expansion difference, resulting in a decrease in yield. Therefore, this heating temperature is 150° C./hour or less, preferably 120° C./hour or less.

(Second Temperature: 670° C. or More and 730° C. or Less)

If the second temperature is less than 670° C., cementite does not become coarse during annealing of the hot-rolled sheet, and pinning energy remains high. This hinders grain growth of ferrite during annealing of the cold-rolled sheet later, and it takes a very long time to make the average grain diameter of ferrite be 10 μm or more, resulting in a decrease in productivity. Therefore, the second temperature is 670° C. or more, preferably 690° C. When the second temperature is more than 730° C., austenite is partially formed during annealing of the hot-rolled sheet, and pearlite transformation occurs in cooling after holding at the second temperature. The pearlite structure formed at this time exerts strong pinning force on the grain growth of ferrite during annealing of the cold-rolled sheet later, and thus grain growth of ferrite is hindered. Therefore, the second temperature is 730° C. or less, preferably 720° C. or less.

(Holding Time at the Second Temperature: 20 Hours or More and 200 Hours or Less)

When the holding time at the second temperature is less than 20 hours, cementite does not become coarse, and pinning energy remains high. This hinders grain growth of ferrite during the cold-rolled sheet annealing later, an amount of cementite existing on a ferrite grain boundary increases unless cold-rolled sheet annealing for a long time is performed, and voids are generated during cold-working, resulting in a decrease in fatigue property. Thus, this time is 20 hours or more, preferably 30 hours or more. When this time is more than 200 hours, it significantly decreases in productivity. Therefore, this time is 200 hours or less, preferably 180 hours or less.

(Heating Rate from the First Temperature to the Second Temperature: 5° C./Hour or More and 80° C./Hour or Less)

By holding the hot-rolled sheet to the first temperature, Mn and Cr can be diffused in cementite, but the concentrations of Mn and Cr contained in cementite vary among plural particles of cementite. This variation of concentrations of Mn and Cr can be alleviated during heating from the first temperature to the second temperature.

The heating rate is preferred to be as low as possible in order to alleviate the variation of concentrations of Mn and Cr. However, when the heating rate from the first temperature to the second temperature is less than 5° C./hour, it significantly decreases in productivity. Thus, this heating rate is 5° C./hour or more, preferably 10° C./hour or more. When this heating rate is more than 80° C./hour, it is not possible to sufficiently alleviate the variation of concentrations of Mn and Cr. This causes cementite with low concentrations of Mn and/or Cr to exist, and voids are generated during cold-working, resulting in a decrease in fatigue property. Therefore, this heating rate is 80° C./hour or less, preferably 65° C./hour or less.

Here, a structural change that occurs during heating from the first temperature to the second temperature will be described. Here, it is assumed that, after the holding at the first temperature, cementite with low concentrations of Mn and Cr (first cementite) and cementite with high concentrations of Mn and Cr (second cementite) exist. In either of the first cementite and the second cementite, a local equilibrium state is maintained in the vicinity of the interface between cementite and a parent phase (ferrite phase), and the concentrations of Mn and Cr contained in this cementite do not change unless flowing-in or flowing-out of alloy elements newly occur.

When the hot-rolled sheet is heated after held at the first temperature, and the frequency of diffusion of atoms is increased thereby, C is discharged from cementite to a ferrite phase. Since the Mn and Cr have an operation to attract C, the amount of C discharged from the second cementite is small, and the amount of C discharged from the first cementite is large. On the other hand, C discharged to the ferrite phase is attracted to the second cementite with high concentrations of Mn and Cr, and adheres to an outer skin of the second cementite, thereby forming new cementite (third cementite).

The third cementite which is just formed does not substantially contain Mn and Cr, and thus attempts to contain Mn and Cr in concentrations illustrated in FIG. 4. However, the diffusion rate of Mn and Cr in cementite is affected by mutual attraction with C, and is quite slow compared to that in the ferrite phase. Thus, Mn and Cr contained in the adjacent second cementite do not easily diffuse to the third cementite. Therefore, in order to maintain the distribution equilibrium, the third cementite is supplied with Mn and Cr from the ferrite phase, resulting in that the third cementite contains Mn and Cr in about the same concentrations as those of the second cementite. Further, the first cementite also increases in concentrations of Mn and Cr along with the discharge of C, and thus contains Mn and Cr in about the same concentrations as those of the second cementite. In this manner, the variation of concentrations of Mn and Cr among plural cementite particles is alleviated. Therefore, in view of the variation of concentrations of Mn and Cr, the heating rate is preferred to be as low as possible, and when the heating rate is excessively high, it is not possible to sufficiently alleviate the variation of concentrations of Mn and Cr.

(Third Temperature: 450° C. or More and 550° C. or Less)

In this embodiment, while the cold-rolled sheet is held at the third temperature, Mn and Cr are diffused through cementite, so as to increase the concentrations of Mn and Cr contained in cementite. When the third temperature is less than 450° C., productivity decreases similarly to when the first temperature is less than 450° C. Thus, the third temperature is 450° C. or more, preferably 480° C. or more. When the third temperature is more than 550° C., similarly to when the first temperature is more than 550° C., it is not possible to make cementite contain sufficient amounts of Mn and Cr. Therefore, the third temperature is 550° C. or less, preferably 520° C. or less.

(Holding Time at the Third Temperature: One Hour or More and Less than 10 Hours)

The concentrations of Mn and Cr contained in cementite are closely related to the holding time at the third temperature. When this time is less than one hour, it is not possible to make cementite contain sufficient amounts of Mn and Cr. Therefore, this time is one hour or more, preferably 1.5 hours or more. When this time is more than 10 hours, increases of the concentrations of Mn and Cr contained in cementite become small, which takes time and cost in particular. Therefore, this time is 10 hours or less, preferably seven hours or less.

(Heating Rate from 60° C. to the Third Temperature: 30° C./Hour or More and 150° C. or Less)

In the cold-rolled sheet annealing, for example, heating from room temperature is performed, and if the heating rate from 60° C. to the third temperature is less than 30° C./hour, productivity decreases similarly to when the heating rate from 60° C. to the first temperature is less than 30° C./hour. Therefore, this heating rate is 30° C./hour or more, preferably 60° C./hour or more. When this heating rate is more than 150° C./hour, the temperature difference between an inside portion and an outside portion of the coil of the hot-rolled sheet becomes large, and scratches and/or deformation of coiling shape occurs due to an expansion difference, resulting in a decrease in yield. Therefore, this heating temperature is 150° C./hour or less, preferably 120° C./hour or less.

(Fourth Temperature: 670° C. or More and 730° C. or Less)

In this embodiment, while the cold-rolled sheet is held at the fourth temperature, a distortion introduced by the cold-rolling is used as driving force to control the average grain diameter of ferrite to 10 μm or more by nucleation-type recrystallization, recrystallization in situ or distortion-induced grain boundary migration of ferrite. As described above, when the average grain boundary of ferrite is 10 μm or more, excellent formability can be obtained. When the fourth temperature is less than 670° C., non-recrystallized ferrite remains after cold-rolled sheet annealing, and the average grain diameter of ferrite does not become 10 or more, with which excellent formability cannot be obtained. Therefore, the fourth temperature is 670° C. or more, preferably 690° C. When the fourth temperature is more than 730° C., austenite is partially generated during the cold-rolled sheet annealing, and pearlite transformation occurs in cooling after holding at the fourth temperature. When the pearlite transformation occurs, the spheroidized ratio of cementite decreases, and voids are easily generated during cold-working, resulting in a decrease in fatigue property. Therefore, the fourth temperature is 730° C. or less, preferably 720° C. or less.

(Holding Time at the Fourth Temperature: 20 Hours or More and 200 Hours or Less)

When the holding time at the fourth temperature is less than 20 hours, non-recrystallized ferrite remains after cold-rolled sheet annealing, and the average grain diameter of ferrite does not become 10 or more, with which excellent formability cannot be obtained. Thus, this time is 20 hours or more, preferably 30 hours or more. When this time is more than 200 hours, it significantly decreases in productivity. Therefore, this time is 200 hours or less, preferably 180 hours or less.

The atmosphere of the hot-rolled sheet annealing and the atmosphere of the cold-rolled sheet annealing are not particularly limited, and these annealings can be performed in, for example, an atmosphere containing nitrogen by 95 vol % or more, an atmosphere containing hydrogen by 95 vol % or more, an air atmosphere, or the like.

According to this embodiment, a high-carbon steel sheet can be manufactured in which the concentration of Mn contained in cementite is 2% or more and 8% or less, the concentration of Cr contained in cementite is 2% or more and 8% or less, the average grain diameter of ferrite is 10 μm or more and 50 μm or less, the average particle diameter of cementite is 0.3 μm or more and 1.5 μm or less, and the spheroidized ratio of cementite is 85% or more and 99% or less. In this high-carbon steel sheet, generation of void from cementite during cold-working is suppressed, and a high-carbon steel sheet with an excellent fatigue property after quenching and tempering can be manufactured.

It should be noted that all of the above-described embodiments merely illustrate concrete examples of implementing the present invention, and the technical scope of the present invention is not to be construed in a restrictive manner by these embodiments. That is, the present invention may be implemented in various forms without departing from the technical spirit or main features thereof.

EXAMPLE

Next, examples of the present invention will be described. Conditions in the examples are condition examples employed for confirming feasibility and effect of the present invention, and the present invention is not limited to these condition examples. The present invention can employ various conditions as long as the object of the present invention is achieved without departing from the spirit of the invention.

First Experiment

In a first experiment, hot-rolling of a slab (steel type A to AT) having a chemical composition illustrated in Table 1 and a thickness of 250 mm was performed, thereby obtaining a coil of a hot-rolled sheet having a thickness of 2.5 mm. In the hot-rolling, the heating temperature of slab was 1140° C., the time thereof was one hour, the finishing temperature of finish-rolling was 880° C., and the coiling temperature was 510° C. Then, the hot-rolled sheet was pickled while it was uncoiled, and the hot-rolled sheet after the pickling was annealed, thereby obtaining a hot-rolled annealed sheet. The atmosphere of the hot-rolled sheet annealing was an atmosphere of 95 vol % hydrogen-5 vol % nitrogen. Thereafter, cold-rolling of the hot-rolled annealed sheet was performed with a reduction ratio of 18%, thereby obtaining a cold-rolled sheet. Subsequently, the cold-rolled sheet was annealed. The atmosphere of the cold-rolled sheet annealing was an atmosphere of 95 vol % hydrogen-5 vol % nitrogen. In the hot-rolled sheet annealing and the cold-rolled sheet annealing, the hot-rolled sheet or the cold-rolled sheet was heated from room temperature, the heating rate from 60° C. to 495° C. was set to 85° C./hour, the sheet was held at 495° C. for 2.8 hours, heating from 495° C. to 710° C. was performed at a heating rate of 65° C./hour, the sheet was held at 710° C. for 65 hours, and thereafter cooled to room temperature by furnace cooling. Various high-carbon steel sheets were produced in this manner. Blank fields in Table 1 indicate that the content of this element is less than a detection limit, and the balance is Fe and impurities. An underline in Table 1 indicates that this numeric value is out of the range of the present invention.

TABLE 1

| STEEL TYPE | CHEMICAL COMPOSITION (MASS %) C | Si | Mn | P | S | Al | N | Cr | Mg | Ca | Y | Zr | La | Ce | NOTE |
|---|---|---|---|---|---|---|---|---|---|---|---|---|---|---|---|
| A | 0.70 | 0.39 | 0.69 | 0.0163 | 0.0058 | 0.007 | 0.0058 | 0.87 | | | | | | | INVENTION EXAMPLE |
| B | 0.76 | 0.13 | 0.42 | 0.0076 | 0.0012 | 0.048 | 0.0096 | 0.77 | | | | | | | INVENTION EXAMPLE |
| C | 0.77 | 0.31 | 1.44 | 0.0083 | 0.0039 | 0.008 | 0.0088 | 0.41 | | | | | | | INVENTION EXAMPLE |
| D | 0.73 | 0.22 | 0.91 | 0.0096 | 0.0051 | 0.003 | 0.0035 | 0.86 | | | | | | | INVENTION EXAMPLE |
| E | 0.87 | 0.29 | 0.52 | 0.0045 | 0.0043 | 0.016 | 0.0029 | 0.62 | | | | | | | INVENTION EXAMPLE |
| F | 0.63 | 0.30 | 1.19 | 0.0074 | 0.0048 | 0.032 | 0.0077 | 0.25 | | | | | | | INVENTION EXAMPLE |
| G | 0.87 | 0.19 | 0.58 | 0.0045 | 0.0057 | 0.047 | 0.0074 | 0.70 | | | | | | | INVENTION EXAMPLE |
| H | 0.79 | 0.33 | 1.31 | 0.0004 | 0.0036 | 0.035 | 0.0066 | 0.83 | | | | | | | INVENTION EXAMPLE |
| I | 0.74 | 0.36 | 0.74 | 0.0138 | 0.0032 | 0.045 | 0.0019 | 0.30 | | | | | | | INVENTION EXAMPLE |
| J | 0.89 | 0.24 | 0.46 | 0.0057 | 0.0004 | 0.046 | 0.0054 | 0.34 | | | | | | | INVENTION EXAMPLE |
| K | 0.61 | 0.31 | 0.35 | 0.0184 | 0.0033 | 0.022 | 0.0080 | 0.52 | | | | | | | INVENTION EXAMPLE |
| L | 0.71 | 0.16 | 0.62 | 0.0121 | 0.0049 | 0.007 | 0.0090 | 0.82 | | | | | | | INVENTION EXAMPLE |
| M | 0.66 | 0.18 | 1.15 | 0.0089 | 0.0017 | 0.040 | 0.0045 | 0.49 | | | | | | | INVENTION EXAMPLE |
| N | 0.67 | 0.12 | 0.97 | 0.0151 | 0.0007 | 0.027 | 0.0012 | 0.58 | | | | | | | INVENTION EXAMPLE |
| O | 0.72 | 0.26 | 1.20 | 0.0029 | 0.0026 | 0.014 | 0.0086 | 0.29 | | | | | | | INVENTION EXAMPLE |
| P | 0.72 | 0.36 | 0.28 | 0.0049 | 0.0049 | 0.017 | 0.0030 | 0.93 | | | | | | | COMPARATIVE EXAMPLE |
| Q | 0.67 | 0.37 | 1.52 | 0.0162 | 0.0014 | 0.037 | 0.0043 | 0.43 | | | | | | | COMPARATIVE EXAMPLE |
| R | 0.75 | 0.08 | 0.59 | 0.0040 | 0.0002 | 0.003 | 0.0042 | 0.80 | | | | | | | COMPARATIVE EXAMPLE |
| S | 0.91 | 0.26 | 0.60 | 0.0172 | 0.0023 | 0.011 | 0.0051 | 0.87 | | | | | | | COMPARATIVE EXAMPLE |
| T | 0.88 | 0.45 | 1.01 | 0.0156 | 0.0055 | 0.049 | 0.0056 | 0.52 | | | | | | | COMPARATIVE EXAMPLE |
| U | 0.71 | 0.10 | 0.26 | 0.0056 | 0.0023 | 0.042 | 0.0050 | 0.78 | | | | | | | COMPARATIVE EXAMPLE |
| V | 0.60 | 0.32 | 1.12 | 0.0164 | 0.0063 | 0.007 | 0.0033 | 0.85 | | | | | | | COMPARATIVE EXAMPLE |
| W | 0.65 | 0.22 | 0.36 | 0.0156 | 0.0052 | 0.022 | 0.0035 | 0.18 | | | | | | | COMPARATIVE EXAMPLE |
| X | 0.78 | 0.23 | 1.00 | 0.0117 | 0.0033 | 0.049 | 0.0108 | 0.50 | | | | | | | COMPARATIVE EXAMPLE |
| Y | 0.87 | 0.20 | 0.83 | 0.0210 | 0.0037 | 0.034 | 0.0055 | 0.68 | | | | | | | COMPARATIVE EXAMPLE |
| Z | 0.59 | 0.11 | 1.19 | 0.0063 | 0.0044 | 0.048 | 0.0045 | 0.26 | | | | | | | COMPARATIVE EXAMPLE |
| AA | 0.82 | 0.17 | 1.65 | 0.0106 | 0.0025 | 0.009 | 0.0025 | 0.32 | | | | | | | COMPARATIVE EXAMPLE |
| AB | 0.74 | 0.34 | 1.29 | 0.0088 | 0.0036 | 0.052 | 0.0014 | 0.76 | | | | | | | COMPARATIVE EXAMPLE |
| AC | 0.87 | 0.18 | 0.54 | 0.0188 | 0.0041 | 0.008 | 0.0016 | 0.14 | | | | | | | COMPARATIVE EXAMPLE |
| AD | 0.66 | 0.30 | 1.15 | 0.0079 | 0.0050 | 0.033 | 0.0046 | 1.12 | | | | | | | COMPARATIVE EXAMPLE |
| AE | 0.85 | 0.42 | 0.50 | 0.0114 | 0.0019 | 0.038 | 0.0031 | 0.85 | | | | | | | COMPARATIVE EXAMPLE |
| AF | 0.95 | 0.13 | 0.77 | 0.0194 | 0.0047 | 0.013 | 0.0027 | 0.36 | | | | | | | COMPARATIVE EXAMPLE |
| AG | 0.52 | 0.39 | 0.51 | 0.0122 | 0.0060 | 0.005 | 0.0042 | 0.24 | | | | | | | COMPARATIVE EXAMPLE |
| AH | 0.71 | 0.29 | 0.44 | 0.0138 | 0.0031 | 0.039 | 0.0040 | 1.08 | | | | | | | COMPARATIVE EXAMPLE |
| AI | 0.71 | 0.19 | 0.39 | 0.0088 | 0.0039 | 0.019 | 0.0069 | 0.92 | 0.003 | | 0.006 | 0.008 | 0.009 | | INVENTION EXAMPLE |
| AJ | 0.89 | 0.35 | 1.24 | 0.0040 | 0.0054 | 0.038 | 0.0021 | 0.37 | 0.006 | 0.009 | 0.009 | 0.005 | 0.002 | | INVENTION EXAMPLE |
| AK | 0.62 | 0.25 | 0.94 | 0.0183 | 0.0057 | 0.005 | 0.0034 | 0.49 | | 0.006 | | | | | INVENTION EXAMPLE |
| AL | 0.67 | 0.28 | 0.78 | 0.0014 | 0.0021 | 0.009 | 0.0048 | 0.27 | | 0.002 | | | 0.006 | 0.007 | INVENTION EXAMPLE |
| AM | 0.80 | 0.12 | 0.47 | 0.0120 | 0.0049 | 0.032 | 0.0086 | 0.72 | | | | 0.002 | | 0.009 | INVENTION EXAMPLE |
| AN | 0.85 | 0.38 | 0.70 | 0.0017 | 0.0004 | 0.026 | 0.0056 | 0.58 | 0.009 | | 0.002 | | | 0.002 | INVENTION EXAMPLE |
| AO | 0.88 | 0.39 | 1.27 | 0.0169 | 0.0028 | 0.024 | 0.0044 | 0.96 | | 0.012 | 0.002 | | 0.003 | | COMPARATIVE EXAMPLE |
| AP | 0.78 | 0.40 | 1.13 | 0.0173 | 0.0043 | 0.011 | 0.0025 | 0.78 | 0.006 | 0.008 | | 0.003 | | 0.012 | COMPARATIVE EXAMPLE |
| AQ | 0.79 | 0.16 | 0.52 | 0.0187 | 0.0054 | 0.039 | 0.0016 | 0.62 | 0.014 | | 0.008 | | 0.002 | | COMPARATIVE EXAMPLE |
| AR | 0.89 | 0.27 | 0.96 | 0.0148 | 0.0021 | 0.010 | 0.0047 | 0.74 | | 0.002 | 0.015 | 0.006 | | 0.004 | COMPARATIVE EXAMPLE |
| AS | 0.63 | 0.13 | 1.39 | 0.0056 | 0.0023 | 0.008 | 0.0053 | 0.61 | | | | 0.013 | | | COMPARATIVE EXAMPLE |
| AT | 0.84 | 0.24 | 0.66 | 0.0199 | 0.0043 | 0.027 | 0.0038 | 0.57 | 0.002 | | | | 0.013 | 0.005 | COMPARATIVE EXAMPLE |

Then, the average grain diameter of ferrite, the average particle diameter of cementite, the spheroidized ratio of cementite, and the concentrations of Mn and Cr contained in cementite of each high-carbon steel sheet were measured. The micro structure observation was performed by the above method. Further, cold-rolling simulating cold-working and quenching and tempering were performed by the above method, and counting of voids per 2000 pmt and a fatigue test with respect to rolling contact fatigue were performed. Results of them are illustrated in Table 2. An underline in Table 2 indicates that this numeric value is out of the range of the present invention.

TABLE 2

| SAMPLE No. | STEEL TYPE | STRUCTURE: FERRITE: AVERAGE GRAIN DIAMETER (μm) | CEMENTITE: AVERAGE PARTICLE DIAMETER (μm) | SPHEROIDIZED RATIO (%) | CONCENTRATION OF Mn (%) | CONCENTRATION OF Cr (%) | PROPERTY: NUMBER OF VOIDS | NUMBER OF CYCLES | NOTE |
|---|---|---|---|---|---|---|---|---|---|
| 1 | A | 35.1 | 0.75 | 92.9 | 3.72 | 6.56 | 5.0 | 15439674 | INVENTION EXAMPLE |
| 2 | B | 36.3 | 0.82 | 91.0 | 2.17 | 5.44 | 8.9 | 11933421 | INVENTION EXAMPLE |
| 3 | C | 35.7 | 0.81 | 91.0 | 7.38 | 2.87 | 7.0 | 13695676 | INVENTION EXAMPLE |
| 4 | D | 32.9 | 0.72 | 93.0 | 4.80 | 6.27 | 5.5 | 15036356 | INVENTION EXAMPLE |
| 5 | E | 34.6 | 0.85 | 89.6 | 2.49 | 3.93 | 7.0 | 13738450 | INVENTION EXAMPLE |

TABLE 2-continued

| SAMPLE No. | STEEL TYPE | STRUCTURE: FERRITE: AVERAGE GRAIN DIAMETER (μm) | STRUCTURE: CEMENTITE: AVERAGE PARTICLE DIAMETER (μm) | STRUCTURE: CEMENTITE: SPHEROIDIZED RATIO (%) | STRUCTURE: CEMENTITE: CONCENTRATION OF Mn (%) | STRUCTURE: CEMENTITE: CONCENTRATION OF Cr (%) | PROPERTY: NUMBER OF VOIDS | PROPERTY: NUMBER OF CYCLES | NOTE |
|---|---|---|---|---|---|---|---|---|---|
| 6 | F | 44.5 | 0.89 | 90.4 | 6.76 | 2.04 | 7.5 | 13291430 | INVENTION EXAMPLE |
| 7 | G | 34.1 | 0.82 | 90.2 | 2.78 | 4.43 | 6.2 | 14433940 | INVENTION EXAMPLE |
| 8 | H | 28.9 | 0.67 | 93.2 | 6.62 | 5.68 | 7.1 | 13622521 | INVENTION EXAMPLE |
| 9 | I | 41.4 | 0.92 | 88.8 | 3.87 | 2.16 | 7.0 | 13718146 | INVENTION EXAMPLE |
| 10 | J | 37.3 | 0.94 | 87.8 | 2.17 | 2.11 | 12.6 | 7810802 | INVENTION EXAMPLE |
| 11 | K | 46.1 | 0.90 | 90.2 | 2.02 | 4.36 | 7.0 | 13671347 | INVENTION EXAMPLE |
| 12 | L | 36.1 | 0.78 | 92.2 | 3.32 | 6.11 | 4.8 | 15633291 | INVENTION EXAMPLE |
| 13 | M | 40.0 | 0.82 | 91.8 | 6.38 | 3.87 | 3.9 | 16392860 | INVENTION EXAMPLE |
| 14 | N | 39.3 | 0.82 | 91.9 | 5.34 | 4.52 | 3.9 | 16341822 | INVENTION EXAMPLE |
| 15 | O | 40.2 | 0.88 | 90.0 | 6.37 | 2.14 | 7.7 | 13072649 | INVENTION EXAMPLE |
| 16 | P | 36.0 | 0.79 | 92.0 | 1.49 | 6.86 | 21.9 | 78794 | COMPARATIVE EXAMPLE |
| 17 | Q | 38.4 | 0.80 | 92.3 | 8.37 | 3.35 | 2.3 | 163091 | COMPARATIVE EXAMPLE |
| 18 | R | 55.3 | 0.79 | 91.7 | 3.07 | 5.71 | 5.3 | 157686 | COMPARATIVE EXAMPLE |
| 19 | S | 30.0 | 0.76 | 83.7 | 2.80 | 5.31 | 21.5 | 81181 | COMPARATIVE EXAMPLE |
| 20 | T | 9.2 | 0.83 | 90.0 | 4.80 | 3.26 | 5.2 | 177828 | COMPARATIVE EXAMPLE |
| 21 | U | 38.7 | 0.84 | 91.0 | 1.39 | 5.81 | 21.4 | 81576 | COMPARATIVE EXAMPLE |
| 22 | V | 35.9 | 0.69 | 95.3 | 6.51 | 7.22 | 6.1 | 134905 | COMPARATIVE EXAMPLE |
| 23 | W | 48.2 | 1.58 | 87.4 | 2.01 | 1.44 | 16.9 | 136719 | COMPARATIVE EXAMPLE |
| 24 | X | 36.4 | 0.84 | 90.5 | 5.09 | 3.46 | 4.4 | 229457 | COMPARATIVE EXAMPLE |
| 25 | Y | 32.4 | 0.80 | 90.6 | 3.97 | 4.31 | 5.3 | 108369 | COMPARATIVE EXAMPLE |
| 26 | Z | 46.4 | 0.89 | 80.9 | 6.98 | 2.24 | 5.9 | 210300 | COMPARATIVE EXAMPLE |
| 27 | AA | 34.4 | 0.82 | 90.6 | 8.17 | 2.13 | 2.8 | 94273 | COMPARATIVE EXAMPLE |
| 28 | AB | 31.8 | 0.70 | 93.2 | 6.75 | 5.48 | 6.1 | 143364 | COMPARATIVE EXAMPLE |
| 29 | AC | 39.4 | 1.72 | 86.9 | 2.58 | 0.89 | 39.2 | 38040 | COMPARATIVE EXAMPLE |
| 30 | AD | 26.0 | 0.24 | 96.5 | 6.38 | 8.84 | 10.1 | 22387 | COMPARATIVE EXAMPLE |
| 31 | AE | 9.3 | 0.78 | 91.0 | 2.43 | 5.49 | 8.4 | 166781 | COMPARATIVE EXAMPLE |
| 32 | AF | 34.4 | 0.90 | 80.9 | 3.50 | 2.12 | 21.3 | 82461 | COMPARATIVE EXAMPLE |
| 33 | AG | 54.4 | 0.95 | 89.1 | 3.17 | 2.27 | 4.2 | 191750 | COMPARATIVE EXAMPLE |
| 34 | AH | 32.6 | 0.26 | 93.6 | 2.35 | 8.05 | 3.1 | 110695 | COMPARATIVE EXAMPLE |
| 35 | AI | 35.8 | 0.77 | 92.3 | 2.09 | 6.86 | 10.6 | 15190303 | INVENTION EXAMPLE |
| 36 | AJ | 33.8 | 0.85 | 89.6 | 5.86 | 2.30 | 8.5 | 16059367 | INVENTION EXAMPLE |
| 37 | AK | 42.9 | 0.85 | 91.6 | 5.38 | 4.06 | 3.4 | 18145610 | INVENTION EXAMPLE |
| 38 | AL | 44.4 | 0.92 | 89.1 | 4.30 | 2.11 | 6.6 | 16838782 | INVENTION EXAMPLE |
| 39 | AM | 35.5 | 0.83 | 90.5 | 2.36 | 4.88 | 7.6 | 16455579 | INVENTION EXAMPLE |
| 40 | AN | 34.8 | 0.85 | 89.8 | 3.40 | 3.74 | 4.8 | 17574662 | INVENTION EXAMPLE |
| 41 | AO | 24.5 | 0.61 | 93.0 | 6.04 | 6.02 | 9.2 | 106091 | COMPARATIVE EXAMPLE |
| 42 | AP | 31.4 | 0.72 | 92.5 | 5.75 | 5.40 | 5.8 | 85761 | COMPARATIVE EXAMPLE |
| 43 | AQ | 36.9 | 0.85 | 90.0 | 2.63 | 4.25 | 5.7 | 86716 | COMPARATIVE EXAMPLE |
| 44 | AR | 30.3 | 0.76 | 91.0 | 4.54 | 4.60 | 6.0 | 84763 | COMPARATIVE EXAMPLE |
| 45 | AS | 37.6 | 0.75 | 93.8 | 7.90 | 4.99 | 9.5 | 101952 | COMPARATIVE EXAMPLE |
| 46 | AT | 35.4 | 0.85 | 89.8 | 3.22 | 3.71 | 4.8 | 99717 | COMPARATIVE EXAMPLE |

As illustrated in Table 2, samples No. 1 to No. 15 and No. 35 to No. 40 were within the range of the present invention, and hence succeeded to obtain an excellent rolling contact fatigue property. Specifically, peeling did not occur even when manipulating loads of one million cycles were applied in the fatigue test with respect to rolling contact fatigue.

On the other hand, in sample No. 16, the Mn content of steel type P was too low, and thus the concentration of Mn contained in cementite was too low. There were many voids, and a sufficient rolling contact fatigue property was not obtained. In sample No. 17, the Mn content of steel type Q was too high. Thus, the concentration of Mn contained in cementite was too high, and a sufficient rolling contact fatigue property was not obtained. In sample No. 18, the Si content of steel type R was too low. Thus, cementite became coarse during tempering after quenching, and a sufficient rolling contact fatigue property was not obtained. Further, the average grain diameter of ferrite was too large. Thus, a matted surface was generated when the cold-rolling simulating cold-working was performed, which disfigured the surface. In sample No. 19, the C content of steel type S was too high. Thus, there was a large amount of retained austenite after quenching, and a fatigue fracture occurred from the retained austenite. Consequently, there were many voids, and a sufficient rolling contact fatigue property was not obtained. In sample No. 20, the Si content of steel type T was too high. Thus, a coarse Si oxide was generated, a fatigue fracture occurred from this Si oxide, and a sufficient rolling contact fatigue property was not obtained. In sample No. 21, the Mn content of steel type U was too low. Thus, the concentration of Mn contained in cementite was too low, there were many voids, and a sufficient rolling contact fatigue property was not obtained. In sample No. 22, the S content of steel type V was too high. Thus, a coarse sulfide was generated, a fatigue fracture occurred from the sulfide, and a sufficient rolling contact fatigue property was not obtained. In sample No. 23, the Cr content of steel type W was too low. Thus, the concentration of Cr contained in cementite was too low, there were many voids, and a sufficient rolling contact fatigue property was not obtained. In sample No. 24, the N content of steel type X was too high. Thus, pinning force of austenite by AlN was too large, austenite grains became excessively fine and pearlite was formed during cooling of quenching, and a fatigue fracture occurred from this pearlite. Consequently, a sufficient rolling contact fatigue property was not obtained. In sample No. 25, the P content of steel type Y was too high. Thus, a crack occurred during quenching, a fatigue fracture occurred from this crack, and a sufficient rolling contact fatigue property was not obtained. In sample No. 26, the C content of steel type Z was too low. Thus, pearlite was formed during quenching, a fatigue fracture occurred from this pearlite, and a sufficient rolling contact fatigue property was not obtained. In sample No. 27, the Mn content of steel type AA was too high. Thus, the concentration of Mn contained in cementite was too high, and a sufficient rolling contact fatigue property was not obtained. In sample No. 28, the Al content of steel type AB was too high. Thus, a coarse Al oxide was generated, a fatigue fracture occurred from this Al oxide, and a sufficient rolling contact fatigue property was not obtained. In sample No. 29, the Cr content of steel type AC was too low. Thus, the concentration of Cr contained in cementite was too low, there were many voids, and a sufficient rolling contact fatigue property was not obtained. In sample No. 30, the Cr content of steel type AD was too high. Thus, the concentration of Cr contained in cementite was too high, and a sufficient rolling contact fatigue property was not obtained. In sample No. 31, the Si content of steel type AE was too high. Thus, a coarse Si oxide was generated, a fatigue fracture occurred from this Si oxide, and a sufficient rolling contact fatigue property was not obtained. In sample No. 32, the C content of steel type AF was too high. Thus, there was a large amount of retained austenite after quenching, and a fatigue fracture occurred from the retained austenite. Consequently, there were many voids, and a sufficient rolling contact fatigue property was not obtained. In sample No. 33, the C content of steel type AG was too low. Thus, pearlite was formed during quenching, a fatigue fracture occurred from this pearlite, and a sufficient rolling contact fatigue property was not obtained. In sample No. 34, the Cr content of steel type AH was too high. Thus, the concentration of Cr contained in cementite was too high, and a sufficient rolling contact fatigue property was not obtained.

In sample No. 41, the Ca content of steel type AO was too high. Thus, a coarse Ca oxide was generated, a fatigue fracture occurred from this Ca oxide, and a sufficient rolling contact fatigue property was not obtained. In sample No. 42, the Ce content of steel type AP was too high. Thus, a coarse Ce oxide was generated, a fatigue fracture occurred from this Ce oxide, and a sufficient rolling contact fatigue property was not obtained. In sample No. 43, the Mg content of steel type AQ was too high. Thus, a coarse Mg oxide was generated, a fatigue fracture occurred from this Mg oxide, and a sufficient rolling contact fatigue property was not obtained. In sample No. 44, the Y content of steel type AR was too high. Thus, a coarse Y oxide was generated, a fatigue fracture occurred from this Y oxide, and a sufficient rolling contact fatigue property was not obtained. In sample No. 45, the Zr content of steel type AS was too high. Thus, a coarse Zr oxide was generated, a fatigue fracture occurred from this Zr oxide, and a sufficient rolling contact fatigue property was not obtained. In sample No. 46, the La content of steel type AT was too high. Thus, a coarse La oxide was generated, a fatigue fracture occurred from this La oxide, and a sufficient rolling contact fatigue property was not obtained.

Second Experiment

In a second experiment, hot-rolling, hot-rolled sheet annealing, cold-rolling and cold-rolled sheet annealing of particular steel types (steel types A, B, C, D, E, F, G, H, I, J, K, L, M, N, O, AI, AJ, AK, AL, AM and AN) selected from the steel types used in the first experiment were performed under various conditions, thereby producing high-carbon steel sheets. These conditions are illustrated in Table 3, Table 4, Table 5 and Table 6. An underline in Table 3 to Table 6 indicates that this numeric value is out of the range of the present invention. Conditions not described in Table 3 to Table 6 are the same as those in the first experiment.

TABLE 3

| | | HOT-ROLLING | | HOT-ROLLED SHEET ANNEALING | | | | | | |
|---|---|---|---|---|---|---|---|---|---|---|
| | | | | 60° C. TO FIRST TEMPERATURE | | | FIRST TEMPERATURE TO SECOND TEMPERATURE | | | |
| SAMPLE No. | STEEL TYPE | FINISHING TEMPERATURE OF FINISH ROLLING (° C.) | COILING TEMPERATURE (° C.) | HEATING RATE (° C./hr) | FIRST TEMPERATURE (° C.) | HOLDING TIME (hr) | HEATING RATE (° C./hr) | SECOND TEMPERATURE (° C.) | HOLDING TIME (hr) | NOTE |
| 51 | A | 949 | 528 | 44 | 501 | 7.6 | 76 | 726 | 115.1 | INVENTION EXAMPLE |
| 52 | B | 875 | 453 | 101 | 463 | 4.2 | 71 | 691 | 193.4 | INVENTION EXAMPLE |
| 53 | C | 901 | 542 | 148 | 529 | 3.3 | 25 | 723 | 149.3 | COMPARATIVE EXAMPLE |
| 54 | D | 835 | 502 | 69 | 471 | 4.0 | 47 | 672 | 132.6 | INVENTION EXAMPLE |
| 55 | E | 835 | 465 | 141 | 489 | 3.9 | 57 | 693 | 44.9 | INVENTION EXAMPLE |
| 56 | F | 815 | 539 | 101 | 490 | 2.3 | 35 | 689 | 84.0 | INVENTION EXAMPLE |
| 57 | G | 815 | 501 | 35 | 549 | 3.2 | 76 | 684 | 47.2 | INVENTION EXAMPLE |
| 55 | H | 836 | 522 | 116 | 500 | 9.4 | 60 | 706 | 87.2 | INVENTION EXAMPLE |
| 59 | I | 876 | 495 | 141 | 533 | 1.6 | 76 | 688 | 16.4 | COMPARATIVE EXAMPLE |
| 60 | J | 889 | 481 | 60 | 523 | 6.8 | 7 | 723 | 121.0 | INVENTION EXAMPLE |
| 61 | K | 861 | 460 | 106 | 473 | 3.8 | 63 | 719 | 70.0 | INVENTION EXAMPLE |
| 62 | L | 891 | 481 | 92 | 483 | 3.5 | 18 | 685 | 114.1 | INVENTION EXAMPLE |
| 63 | M | 820 | 487 | 24 | 460 | 8.6 | 49 | 676 | 191.2 | COMPARATIVE EXAMPLE |
| 64 | N | 860 | 539 | 135 | 540 | 1.1 | 98 | 709 | 66.9 | COMPARATIVE EXAMPLE |
| 65 | O | 881 | 535 | 102 | 483 | 2.2 | 40 | 712 | 85.9 | COMPARATIVE EXAMPLE |
| 66 | AI | 803 | 463 | 94 | 505 | 6.9 | 24 | 691 | 23.4 | INVENTION EXAMPLE |
| 67 | AJ | 812 | 544 | 74 | 525 | 5.2 | 70 | 725 | 84.7 | INVENTION EXAMPLE |
| 68 | AK | 832 | 568 | 73 | 484 | 7.0 | 44 | 715 | 100.1 | COMPARATIVE EXAMPLE |
| 69 | AL | 925 | 524 | 74 | 485 | 1.1 | 59 | 721 | 196.6 | COMPARATIVE EXAMPLE |
| 70 | AM | 840 | 438 | 96 | 510 | 6.2 | 55 | 674 | 179.7 | COMPARATIVE EXAMPLE |
| 71 | AN | 851 | 457 | 106 | 543 | 4.1 | 10 | 699 | 40.0 | INVENTION EXAMPLE |
| 72 | A | 803 | 577 | 38 | 515 | 5.2 | 10 | 703 | 141.2 | COMPARATIVE EXAMPLE |

TABLE 3-continued

| | | HOT-ROLLING | | HOT-ROLLED SHEET ANNEALING | | | | | | |
|---|---|---|---|---|---|---|---|---|---|---|
| | | | | 60° C. TO FIRST TEMPERATURE | | | FIRST TEMPERATURE TO SECOND TEMPERATURE | | | |
| SAMPLE No. | STEEL TYPE | FINISHING TEMPERATURE OF FINISH ROLLING (° C.) | COILING TEMPERATURE (° C.) | HEATING RATE (° C./hr) | FIRST TEMPERATURE (° C.) | HOLDING TIME (hr) | HEATING RATE (° C./hr) | SECOND TEMPERATURE (° C.) | HOLDING TIME (hr) | NOTE |
| 73 | B | 849 | 537 | 55 | 556 | 1.5 | 58 | 714 | 163.5 | COMPARATIVE EXAMPLE |
| 74 | C | 926 | 475 | 102 | 536 | 6.3 | 26 | 701 | 129.3 | INVENTION EXAMPLE |
| 75 | D | 844 | 454 | 111 | 508 | 8.7 | 53 | 716 | 159.6 | COMPARATIVE EXAMPLE |
| 76 | E | 839 | 534 | 105 | 518 | 9.3 | 23 | 689 | 153.6 | INVENTION EXAMPLE |
| 77 | F | 808 | 509 | 132 | 475 | 3.3 | 45 | 729 | 127.2 | INVENTION EXAMPLE |
| 78 | G | 925 | 487 | 47 | 460 | 0.6 | 63 | 714 | 99.7 | COMPARATIVE EXAMPLE |
| 79 | H | 845 | 531 | 96 | 485 | 7.4 | 18 | 734 | 114.0 | COMPARATIVE EXAMPLE |
| 80 | I | 846 | 515 | 75 | 525 | 3.9 | 51 | 716 | 156.3 | INVENTION EXAMPLE |
| 81 | J | 942 | 469 | 99 | 482 | 7.2 | 32 | 709 | 134.9 | COMPARATIVE EXAMPLE |
| 82 | K | 788 | 466 | 38 | 506 | 1.6 | 57 | 676 | 130.8 | COMPARATIVE EXAMPLE |
| 83 | L | 871 | 492 | 86 | 512 | 9.1 | 13 | 713 | 42.4 | INVENTION EXAMPLE |
| 84 | M | 865 | 482 | 144 | 488 | 2.8 | 37 | 717 | 77.5 | INVENTION EXAMPLE |
| 85 | N | 869 | 522 | 27 | 457 | 6.8 | 44 | 686 | 176.7 | COMPARATIVE EXAMPLE |
| 86 | O | 855 | 523 | 69 | 474 | 7.2 | 28 | 706 | 170.8 | INVENTION EXAMPLE |
| 87 | AI | 920 | 521 | 186 | 478 | 9.1 | 40 | 701 | 197.7 | COMPARATIVE EXAMPLE |
| 88 | AJ | 908 | 431 | 54 | 541 | 5.0 | 59 | 718 | 72.4 | COMPARATIVE EXAMPLE |
| 89 | AK | 863 | 487 | 146 | 477 | 8.6 | 6 | 676 | 92.9 | INVENTION EXAMPLE |
| 90 | AL | 935 | 473 | 137 | 482 | 4.3 | 77 | 697 | 35.7 | INVENTION EXAMPLE |
| 91 | AM | 803 | 528 | 43 | 527 | 2.6 | 20 | 706 | 133.1 | INVENTION EXAMPLE |
| 92 | AN | 925 | 472 | 127 | 498 | 9.5 | 61 | 689 | 40.9 | COMPARATIVE EXAMPLE |

TABLE 4

| | | | COLD-ROLLED SHEET ANNEALING | | | | | | |
|---|---|---|---|---|---|---|---|---|---|
| | | | 60° C. TO THIRD TEMPERATURE | | | THIRD TEMPERATURE TO FOURTH TEMPERATURE | | | |
| SAMPLE No. | STEEL TYPE | COLD-ROLLING REDUCTION RATIO (%) | HEATING RATE (° C./hr) | THIRD TEMPERATURE (° C.) | HOLDING TIME (hr) | HEATING RATE (° C./hr) | FOURTH TEMPERATURE (° C.) | HOLDING TIME (hr) | NOTE |
| 51 | A | 7.7 | 54 | 496 | 3.4 | 28 | 678 | 36.1 | INVENTION EXAMPLE |
| 52 | B | 30.7 | 131 | 497 | 7.5 | 57 | 672 | 178.0 | INVENTION EXAMPLE |
| 53 | C | 13.1 | 86 | 536 | 7.6 | 96 | 702 | 89.4 | COMPARATIVE EXAMPLE |
| 54 | D | 24.2 | 115 | 464 | 1.8 | 32 | 724 | 101.2 | INVENTION EXAMPLE |
| 55 | E | 28.9 | 147 | 523 | 5.5 | 34 | 719 | 51.7 | INVENTION EXAMPLE |
| 56 | F | 6.9 | 47 | 473 | 4.5 | 60 | 730 | 72.2 | INVENTION EXAMPLE |
| 57 | G | 31.2 | 58 | 522 | 3.8 | 50 | 685 | 131.3 | INVENTION EXAMPLE |
| 58 | H | 10.5 | 33 | 477 | 7.6 | 44 | 724 | 187.7 | INVENTION EXAMPLE |
| 59 | I | 34.8 | 110 | 452 | 6.5 | 75 | 709 | 45.0 | COMPARATIVE EXAMPLE |
| 60 | J | 13.7 | 147 | 474 | 2.1 | 22 | 692 | 93.0 | INVENTION EXAMPLE |
| 61 | K | 10.8 | 65 | 497 | 3.6 | 21 | 714 | 66.9 | INVENTION EXAMPLE |
| 82 | L | 31.0 | 64 | 486 | 7.3 | 29 | 709 | 35.5 | INVENTION EXAMPLE |
| 63 | M | 19.7 | 70 | 482 | 4.8 | 37 | 682 | 36.7 | COMPARATIVE EXAMPLE |
| 64 | N | 25.6 | 141 | 538 | 5.9 | 58 | 722 | 188.9 | COMPARATIVE EXAMPLE |
| 65 | O | 30.9 | 40 | 433 | 2.6 | 38 | 713 | 101.7 | COMPARATIVE EXAMPLE |
| 66 | AI | 18.5 | 139 | 496 | 5.8 | 26 | 718 | 152.2 | INVENTION EXAMPLE |
| 67 | AJ | 30.8 | 51 | 503 | 8.3 | 51 | 682 | 180.2 | INVENTION EXAMPLE |
| 68 | AK | 6.0 | 60 | 542 | 2.5 | 49 | 707 | 87.0 | COMPARATIVE EXAMPLE |
| 69 | AL | 31.2 | 75 | 522 | 8.1 | 72 | 736 | 102.3 | COMPARATIVE EXAMPLE |
| 70 | AM | 7.7 | 51 | 521 | 9.2 | 20 | 711 | 108.6 | COMPARATIVE EXAMPLE |
| 71 | AN | 27.8 | 88 | 513 | 9.4 | 65 | 699 | 145.1 | INVENTION EXAMPLE |
| 72 | A | 28.5 | 66 | 501 | 4.7 | 47 | 677 | 168.5 | COMPARATIVE EXAMPLE |
| 73 | B | 25.9 | 142 | 528 | 6.3 | 34 | 672 | 42.6 | COMPARATIVE EXAMPLE |
| 74 | C | 17.3 | 71 | 524 | 6.3 | 54 | 692 | 45.8 | INVENTION EXAMPLE |
| 75 | D | 11.0 | 45 | 466 | 0.8 | 37 | 721 | 39.2 | COMPARATIVE EXAMPLE |
| 76 | E | 6.0 | 98 | 462 | 7.2 | 20 | 711 | 138.6 | INVENTION EXAMPLE |
| 77 | F | 33.3 | 32 | 474 | 5.1 | 33 | 679 | 40.4 | INVENTION EXAMPLE |
| 78 | G | 23.9 | 128 | 527 | 6.3 | 52 | 692 | 41.3 | COMPARATIVE EXAMPLE |
| 79 | H | 23.5 | 95 | 549 | 2.8 | 11 | 702 | 84.0 | COMPARATIVE EXAMPLE |
| 80 | I | 34.0 | 87 | 529 | 8.6 | 26 | 695 | 197.9 | INVENTION EXAMPLE |
| 81 | J | 4.1 | 80 | 539 | 7.7 | 45 | 682 | 94.6 | COMPARATIVE EXAMPLE |
| 82 | K | 23.1 | 51 | 479 | 9.3 | 56 | 677 | 66.4 | COMPARATIVE EXAMPLE |
| 83 | L | 12.7 | 68 | 489 | 3.1 | 24 | 699 | 36.8 | INVENTION EXAMPLE |
| 84 | M | 19.2 | 141 | 542 | 4.5 | 75 | 712 | 193.0 | INVENTION EXAMPLE |

TABLE 4-continued

| | | | COLD-ROLLED SHEET ANNEALING | | | | | | |
|---|---|---|---|---|---|---|---|---|---|
| | | COLD- | 60° C. TO THIRD TEMPERATURE | | | THIRD TEMPERATURE TO FOURTH TEMPERATURE | | | |
| SAMPLE No. | STEEL TYPE | ROLLING REDUCTION RATIO (%) | HEATING RATE (° C./hr) | THIRD TEMPER-ATURE (° C.) | HOLDING TIME (hr) | HEATING RATE (° C./hr) | FOURTH TEMPER-ATURE (° C.) | HOLDING TIME (hr) | NOTE |
| 85 | N | 33.1 | 36 | 461 | 5.5 | 22 | 700 | 56.0 | COMPARATIVE EXAMPLE |
| 86 | O | 19.7 | 32 | 550 | 2.0 | 67 | 725 | 127.5 | INVENTION EXAMPLE |
| 87 | AI | 7.3 | 64 | 518 | 5.5 | 37 | 705 | 91.6 | COMPARATIVE EXAMPLE |
| 88 | AJ | 12.7 | 60 | 526 | 2.0 | 35 | 710 | 98.8 | COMPARATIVE EXAMPLE |
| 89 | AK | 20.3 | 135 | 466 | 7.8 | 47 | 671 | 191.0 | INVENTION EXAMPLE |
| 90 | AL | 28.3 | 114 | 463 | 6.2 | 69 | 724 | 37.6 | INVENTION EXAMPLE |
| 91 | AM | 11.4 | 123 | 548 | 3.2 | 7 | 707 | 181.4 | INVENTION EXAMPLE |
| 92 | AN | 21.2 | 178 | 543 | 9.7 | 29 | 682 | 78.3 | COMPARATIVE EXAMPLE |

TABLE 5

| | | HOT-ROLLING | | HOT-ROLLED SHEET ANNEALING | | | | | | |
|---|---|---|---|---|---|---|---|---|---|---|
| | | FINISHING | | 60° C. TO FIRST TEMPERATURE | | | FIRST TEMPERATURE TO SECOND TEMPERATURE | | | |
| SAM-PLE No. | STEEL TYPE | TEMPERATURE OF FINISH-ROLLING (° C.) | COILING TEMPER-ATURE (° C.) | HEAT-ING RATE (° C./hr) | FIRST TEMPER-ATURE (° C.) | HOLD-ING TIME (hr) | HEAT-ING RATE (° C./hr) | SECOND TEMPER-ATURE (° C.) | HOLD-ING TIME (hr) | NOTE |
| 93 | A | 937 | 520 | 126 | 478 | 3.8 | 13 | 693 | 141.3 | INVENTION EXAMPLE |
| 94 | B | 806 | 461 | 82 | 493 | 4.4 | 49 | 687 | 65.0 | COMPARATIVE EXAMPLE |
| 95 | C | 947 | 534 | 130 | 501 | 5.6 | 28 | 663 | 76.4 | COMPARATIVE EXAMPLE |
| 96 | D | 968 | 502 | 61 | 536 | 9.8 | 62 | 727 | 71.1 | COMPARATIVE EXAMPLE |
| 97 | E | 878 | 493 | 106 | 517 | 4.3 | 40 | 699 | 63.3 | COMPARATIVE EXAMPLE |
| 98 | F | 880 | 471 | 86 | 484 | 9.5 | 50 | 710 | 87.4 | COMPARATIVE EXAMPLE |
| 99 | G | 912 | 498 | 86 | 521 | 7.6 | 64 | 691 | 47.6 | INVENTION EXAMPLE |
| 100 | H | 937 | 492 | 34 | 454 | 4.7 | 35 | 709 | 58.7 | INVENTION EXAMPLE |
| 101 | I | 940 | 481 | 141 | 545 | 2.5 | 10 | 689 | 55.2 | INVENTION EXAMPLE |
| 102 | J | 908 | 545 | 128 | 453 | 5.0 | 19 | 681 | 24.9 | COMPARATIVE EXAMPLE |
| 103 | K | 877 | 496 | 130 | 462 | 2.2 | 57 | 690 | 144.6 | COMPARATIVE EXAMPLE |
| 104 | L | 810 | 499 | 58 | 542 | 8.8 | 73 | 721 | 159.1 | INVENTION EXAMPLE |
| 105 | M | 933 | 483 | 137 | 498 | 2.3 | 35 | 709 | 71.8 | INVENTION EXAMPLE |
| 106 | N | 845 | 497 | 50 | 462 | 5.9 | 63 | 723 | 86.1 | INVENTION EXAMPLE |
| 107 | O | 836 | 464 | 78 | 469 | 1.9 | 7 | 728 | 119.0 | INVENTION EXAMPLE |
| 108 | AI | 906 | 490 | 81 | 472 | 9.4 | 77 | 713 | 92.0 | INVENTION EXAMPLE |
| 109 | AJ | 821 | 463 | 114 | 471 | 7.1 | 80 | 722 | 70.9 | INVENTION EXAMPLE |
| 110 | AK | 866 | 460 | 78 | 538 | 6.2 | 52 | 684 | 88.2 | INVENTION EXAMPLE |
| 111 | AL | 879 | 460 | 146 | 516 | 6.4 | 23 | 686 | 163.3 | COMPARATIVE EXAMPLE |
| 112 | AM | 828 | 513 | 124 | 453 | 4.3 | 22 | 701 | 67.8 | INVENTION EXAMPLE |
| 113 | AN | 823 | 504 | 57 | 561 | 1.8 | 26 | 727 | 28.9 | COMPARATIVE EXAMPLE |

TABLE 6

| | | | COLD-ROLLED SHEET ANNEALING | | | | | | |
|---|---|---|---|---|---|---|---|---|---|
| | | COLD-ROLLING | 60° C. TO THIRD TEMPERATURE | | | THIRD TEMPERATURE TO FOURTH TEMPERATURE | | | |
| SAM-PLE No. | STEEL TYPE | RE-DUCTION RATIO (%) | HEAT-ING RATE (° C./hr) | THIRD TEMPER-ATURE (° C.) | HOLD-ING TIME (hr) | HEAT-ING RATE (° C./hr) | FOURTH TEMPER-ATURE (° C.) | HOLD-ING TIME (hr) | NOTE |
| 93 | A | 6.3 | 135 | 535 | 2.4 | 60 | 703 | 169.4 | INVENTION EXAMPLE |
| 94 | B | 38.2 | 45 | 503 | 6.0 | 36 | 688 | 31.3 | COMPARATIVE EXAMPLE |
| 95 | C | 10.3 | 51 | 458 | 4.1 | 27 | 692 | 25.1 | COMPARATIVE EXAMPLE |
| 96 | D | 18.4 | 87 | 537 | 5.6 | 49 | 677 | 38.6 | COMPARATIVE EXAMPLE |
| 97 | E | 25.7 | 139 | 574 | 2.0 | 60 | 705 | 102.2 | COMPARATIVE EXAMPLE |
| 98 | F | 29.6 | 34 | 521 | 1.8 | 61 | 656 | 86.7 | COMPARATIVE EXAMPLE |
| 99 | G | 22.4 | 54 | 451 | 5.5 | 28 | 682 | 176.6 | INVENTION EXAMPLE |
| 100 | H | 10.2 | 65 | 485 | 9.1 | 25 | 694 | 46.9 | INVENTION EXAMPLE |

TABLE 6-continued

| SAMPLE No. | STEEL TYPE | COLD-ROLLING RE-DUCTION RATIO (%) | COLD-ROLLED SHEET ANNEALING: 60° C. TO THIRD TEMPERATURE: HEATING RATE (° C./hr) | THIRD TEMPERATURE (° C.) | HOLDING TIME (hr) | THIRD TEMPERATURE TO FOURTH TEMPERATURE: HEATING RATE (° C./hr) | FOURTH TEMPERATURE (° C.) | HOLDING TIME (hr) | NOTE |
|---|---|---|---|---|---|---|---|---|---|
| 101 | I | 16.1 | 117 | 526 | 8.0 | 65 | 698 | 184.0 | INVENTION EXAMPLE |
| 102 | J | 17.1 | 78 | 510 | 3.5 | 23 | 711 | 15.3 | COMPARATIVE EXAMPLE |
| 103 | K | 17.8 | 64 | 569 | 2.5 | 57 | 725 | 34.4 | COMPARATIVE EXAMPLE |
| 104 | L | 9.4 | 73 | 481 | 5.1 | 61 | 691 | 97.7 | INVENTION EXAMPLE |
| 105 | M | 13.8 | 148 | 511 | 4.9 | 29 | 719 | 195.8 | INVENTION EXAMPLE |
| 106 | N | 24.4 | 65 | 509 | 5.9 | 76 | 703 | 39.0 | INVENTION EXAMPLE |
| 107 | O | 15.1 | 150 | 548 | 6.2 | 28 | 692 | 162.8 | INVENTION EXAMPLE |
| 108 | AI | 28.4 | 32 | 475 | 2.6 | 49 | 683 | 39.7 | INVENTION EXAMPLE |
| 109 | AJ | 28.5 | 41 | 515 | 1.9 | 66 | 704 | 191.3 | INVENTION EXAMPLE |
| 110 | AK | 19.4 | 72 | 468 | 3.7 | 47 | 729 | 140.3 | INVENTION EXAMPLE |
| 111 | AL | 18.0 | 76 | 441 | 3.8 | 40 | 709 | 33.1 | COMPARATIVE EXAMPLE |
| 112 | AM | 7.1 | 88 | 549 | 4.7 | 55 | 705 | 25.8 | INVENTION EXAMPLE |
| 113 | AN | 21.7 | 123 | 497 | 4.5 | 42 | 681 | 197.0 | COMPARATIVE EXAMPLE |

Then, the average grain diameter of ferrite, the average particle diameter of cementite, the spheroidized ratio of cementite, and the concentrations of Mn and Cr contained in cementite of each high-carbon steel sheet were measured, and moreover, counting of voids and a fatigue test with respect to rolling contact fatigue were performed, similarly to the first experiment. Results of them are illustrated in Table 7 and Table 8. An underline in Table 7 and Table 8 indicates that this numeric value is out of the range of the present invention.

TABLE 7

| SAMPLE No. | STEEL TYPE | STRUCTURE: FERRITE: AVERAGE GRAIN DIAMETER (μm) | CEMENTITE: AVERAGE PARTICLE DIAMETER (μm) | SPHEROIDIZED RATIO (%) | CONCENTRATION OF Mn (%) | CONCENTRATION OF Cr (%) | PROPERTY: NUMBER OF VOIDS | NUMBER OF CYCLES | NOTE |
|---|---|---|---|---|---|---|---|---|---|
| 51 | A | 15.3 | 1.05 | 93.1 | 3.74 | 6.76 | 2.7 | 17368540 | INVENTION EXAMPLE |
| 52 | B | 18.0 | 0.83 | 91.7 | 2.22 | 5.40 | 8.3 | 12536098 | INVENTION EXAMPLE |
| 53 | C | 36.3 | 1.19 | 87.0 | 3.37 | 1.34 | 24.9 | 65122 | COMPARATIVE EXAMPLE |
| 54 | D | 19.4 | 0.77 | 93.7 | 5.33 | 6.60 | 5.0 | 15464961 | INVENTION EXAMPLE |
| 55 | E | 20.4 | 0.73 | 90.0 | 2.54 | 3.91 | 9.2 | 11668718 | INVENTION EXAMPLE |
| 56 | F | 45.5 | 0.95 | 90.3 | 7.26 | 2.13 | 6.5 | 14138917 | INVENTION EXAMPLE |
| 57 | G | 16.0 | 0.55 | 89.8 | 2.77 | 4.26 | 13.8 | 6046709 | INVENTION EXAMPLE |
| 58 | H | 35.6 | 0.92 | 94.0 | 7.12 | 6.08 | 4.3 | 16036762 | INVENTION EXAMPLE |
| 59 | I | 6.3 | 0.59 | 88.6 | 3.83 | 2.07 | 18.9 | 103710 | COMPARATIVE EXAMPLE |
| 60 | J | 28.1 | 1.36 | 88.3 | 2.20 | 2.18 | 5.6 | 14969872 | INVENTION EXAMPLE |
| 61 | K | 46.0 | 1.09 | 91.1 | 2.02 | 4.43 | 4.8 | 15608230 | INVENTION EXAMPLE |
| 62 | L | 23.9 | 0.63 | 92.3 | 3.36 | 5.96 | 7.3 | 13390170 | INVENTION EXAMPLE |
| 63 | M | 10.7 | 0.61 | 91.5 | 6.41 | 3.70 | 7.0 | 13708366 | COMPARATIVE EXAMPLE |
| 64 | N | 33.1 | 1.08 | 87.2 | 2.32 | 1.96 | 22.4 | 75958 | COMPARATIVE EXAMPLE |
| 65 | O | 36.4 | 0.99 | 87.1 | 3.64 | 1.22 | 38.9 | 38474 | COMPARATIVE EXAMPLE |
| 66 | AI | 19.3 | 0.82 | 93.8 | 2.24 | 7.15 | 8.6 | 16020011 | INVENTION EXAMPLE |
| 67 | AJ | 25.7 | 1.05 | 89.4 | 5.85 | 2.35 | 5.3 | 17381596 | INVENTION EXAMPLE |
| 68 | AK | 43.7 | 0.96 | 79.1 | 1.46 | 1.15 | 35.7 | 118726 | COMPARATIVE EXAMPLE |
| 69 | AL | 63.8 | 1.63 | 80.3 | 3.59 | 1.79 | 31.4 | 200416 | COMPARATIVE EXAMPLE |
| 70 | AM | 38.9 | 0.81 | 91.6 | 2.54 | 5.00 | 6.9 | 16739608 | COMPARATIVE EXAMPLE |
| 71 | AN | 22.3 | 0.74 | 90.4 | 3.43 | 3.72 | 6.3 | 16973450 | INVENTION EXAMPLE |
| 72 | A | 19.4 | 0.73 | 78.5 | 1.77 | 1.58 | 32.7 | 46436 | COMPARATIVE EXAMPLE |
| 73 | B | 13.8 | 1.03 | 87.6 | 1.27 | 3.21 | 35.7 | 42127 | COMPARATIVE EXAMPLE |
| 74 | C | 16.3 | 0.84 | 91.4 | 7.41 | 2.84 | 6.8 | 13842979 | INVENTION EXAMPLE |
| 75 | D | 35.2 | 1.06 | 87.5 | 1.47 | 1.94 | 32.7 | 46527 | COMPARATIVE EXAMPLE |
| 76 | E | 45.8 | 0.90 | 89.5 | 2.65 | 4.06 | 5.5 | 14992403 | INVENTION EXAMPLE |
| 77 | F | 20.6 | 1.39 | 91.0 | 6.84 | 2.13 | 2.8 | 17263889 | INVENTION EXAMPLE |
| 78 | G | 10.2 | 0.47 | 90.5 | 1.50 | 1.68 | 113.6 | 13221 | COMPARATIVE EXAMPLE |
| 79 | H | 9.4 | 1.08 | 93.7 | 6.71 | 5.98 | 21.0 | 84484 | COMPARATIVE EXAMPLE |
| 80 | I | 49.2 | 1.28 | 89.1 | 4.00 | 2.25 | 3.3 | 16860931 | INVENTION EXAMPLE |
| 81 | J | 19.8 | 1.12 | 88.2 | 2.20 | 2.13 | 25.4 | 63308 | COMPARATIVE EXAMPLE |
| 82 | K | 11.8 | 0.62 | 90.1 | 2.01 | 4.12 | 15.0 | 2369850 | COMPARATIVE EXAMPLE |
| 83 | L | 15.8 | 0.67 | 92.1 | 3.19 | 5.90 | 6.5 | 14124858 | INVENTION EXAMPLE |
| 84 | M | 48.4 | 1.09 | 93.0 | 6.60 | 4.04 | 2.2 | 17706361 | INVENTION EXAMPLE |
| 85 | N | 19.8 | 0.71 | 91.4 | 5.47 | 4.47 | 5.1 | 15321973 | COMPARATIVE EXAMPLE |

TABLE 7-continued

| SAMPLE No. | STEEL TYPE | STRUCTURE: FERRITE AVERAGE GRAIN DIAMETER (μm) | STRUCTURE: CEMENTITE AVERAGE PARTICLE DIAMETER (μm) | STRUCTURE: CEMENTITE SPHEROIDIZED RATIO (%) | STRUCTURE: CEMENTITE CONCENTRATION OF Mn (%) | STRUCTURE: CEMENTITE CONCENTRATION OF Cr (%) | PROPERTY: NUMBER OF VOIDS | PROPERTY: NUMBER OF CYCLES | NOTE |
|---|---|---|---|---|---|---|---|---|---|
| 86 | O | 49.0 | 1.22 | 90.5 | 6.82 | 2.28 | 3.5 | 16654364 | INVENTION EXAMPLE |
| 87 | AI | 39.7 | 0.91 | 92.4 | 2.17 | 7.04 | 7.3 | 16565216 | COMPARATIVE EXAMPLE |
| 88 | AJ | 49.5 | 1.07 | 90.8 | 5.90 | 2.35 | 5.2 | 17428798 | COMPARATIVE EXAMPLE |
| 89 | AK | 15.8 | 0.57 | 91.3 | 5.40 | 3.88 | 7.6 | 16457197 | INVENTION EXAMPLE |
| 90 | AL | 26.1 | 0.77 | 89.4 | 4.33 | 2.08 | 9.8 | 15520663 | INVENTION EXAMPLE |
| 91 | AM | 47.9 | 1.01 | 90.6 | 2.47 | 5.08 | 4.6 | 17635328 | INVENTION EXAMPLE |
| 92 | AN | 11.9 | 0.54 | 89.6 | 3.28 | 3.50 | 12.4 | 14423892 | COMPARATIVE EXAMPLE |

TABLE 8

| SAMPLE No. | STEEL TYPE | STRUCTURE: FERRITE AVERAGE GRAIN DIAMETER (μm) | STRUCTURE: CEMENTITE AVERAGE PARTICLE DIAMETER (μm) | STRUCTURE: CEMENTITE SPHEROIDIZED RATIO (%) | STRUCTURE: CEMENTITE CONCENTRATION OF Mn (%) | STRUCTURE: CEMENTITE CONCENTRATION OF Cr (%) | PROPERTY: NUMBER OF VOIDS | PROPERTY: NUMBER OF CYCLES | NOTE |
|---|---|---|---|---|---|---|---|---|---|
| 93 | A | 48.0 | 0.79 | 92.9 | 3.91 | 6.73 | 4.6 | 15752497 | INVENTION EXAMPLE |
| 94 | B | 9.4 | 0.55 | 90.8 | 2.09 | 5.08 | 21.7 | 79674 | COMPARATIVE EXAMPLE |
| 95 | C | 7.7 | 0.39 | 89.6 | 7.20 | 2.62 | 31.0 | 49374 | COMPARATIVE EXAMPLE |
| 96 | D | 13.0 | 0.90 | 93.5 | 4.71 | 6.32 | 3.5 | 16647961 | COMPARATIVE EXAMPLE |
| 97 | E | 25.6 | 0.78 | 86.8 | 1.20 | 1.86 | 49.1 | 30272 | COMPARATIVE EXAMPLE |
| 98 | F | 9.8 | 0.92 | 90.8 | 6.64 | 2.01 | 21.5 | 80896 | COMPARATIVE EXAMPLE |
| 99 | G | 20.3 | 0.60 | 89.9 | 2.76 | 4.29 | 11.7 | 8926966 | INVENTION EXAMPLE |
| 100 | H | 14.6 | 0.61 | 93.1 | 6.44 | 5.53 | 8.4 | 12328541 | INVENTION EXAMPLE |
| 101 | I | 29.4 | 0.81 | 89.1 | 4.02 | 2.18 | 8.8 | 12075804 | INVENTION EXAMPLE |
| 102 | J | 9.8 | 0.47 | 87.1 | 2.08 | 1.94 | 60.7 | 24513 | COMPARATIVE EXAMPLE |
| 103 | K | 43.7 | 0.88 | 87.1 | 1.06 | 2.23 | 28.8 | 53952 | COMPARATIVE EXAMPLE |
| 104 | L | 28.6 | 1.17 | 93.2 | 3.40 | 6.37 | 2.1 | 17794699 | INVENTION EXAMPLE |
| 105 | M | 46.1 | 1.08 | 93.2 | 6.77 | 4.09 | 2.3 | 17641981 | INVENTION EXAMPLE |
| 106 | N | 22.6 | 1.03 | 92.4 | 5.32 | 4.59 | 2.4 | 17519258 | INVENTION EXAMPLE |
| 107 | O | 41.3 | 1.41 | 91.3 | 6.48 | 2.23 | 2.7 | 17323868 | INVENTION EXAMPLE |
| 108 | AI | 13.6 | 0.85 | 92.7 | 2.06 | 6.82 | 9.1 | 15827951 | INVENTION EXAMPLE |
| 109 | AJ | 38.4 | 1.12 | 90.6 | 5.94 | 2.37 | 4.6 | 17672241 | INVENTION EXAMPLE |
| 110 | AK | 31.5 | 1.08 | 93.4 | 6.01 | 4.36 | 2.1 | 18656318 | INVENTION EXAMPLE |
| 111 | AL | 21.3 | 0.83 | 86.7 | 2.14 | 1.01 | 38.2 | 101165 | COMPARATIVE EXAMPLE |
| 112 | AM | 15.1 | 0.67 | 90.0 | 2.31 | 4.71 | 12.1 | 14551245 | INVENTION EXAMPLE |
| 113 | AN | 33.4 | 0.83 | 86.8 | 1.54 | 1.74 | 32.7 | 160732 | COMPARATIVE EXAMPLE |

As illustrated in Table 7 and Table 8, samples No. 51, No. 52, No. 54 to No. 58, No. 60 to No. 62, No. 66, No. 67, No. 71, No. 74, No. 76, No. 77, No. 80, No. 83, No. 84, No. 86, No. 89 to No. 91, No. 93, No. 99 to No. 101, No. 104 to No. 110, and No. 112 were within the range of the present invention, and hence succeeded to obtain an excellent rolling contact fatigue property. Specifically, peeling did not occur even when manipulating loads of one million cycles were applied in the fatigue test with respect to rolling contact fatigue.

On the other hand, in sample No. 53, the heating rate from the third temperature to the fourth temperature was too high. Thus, the temperature difference between a center portion and a circumferential edge portion of the cold-rolled sheet coil was too large, and scratches due to a thermal expansion difference occurred. Further, the concentration of Cr contained in cementite was too low, there were many voids, and a sufficient rolling contact fatigue property was not obtained. In sample No. 59, the holding time at the second temperature was too short. Thus, the average grain diameter of ferrite was small, there were many voids, and a sufficient rolling contact fatigue property was not obtained. In sample No. 63, the heating rate from 60° C. to the first temperature was too low, and thus productivity was quite low. In sample No. 64, the heating rate from the first temperature to the second temperature was too high. Thus, the temperature difference between a center portion and a circumferential edge portion of the cold-rolled sheet coil was too large, and scratches due to a thermal expansion difference occurred. Further, the concentration of Cr contained in cementite was too low, there were many voids, and a sufficient rolling contact fatigue property was not obtained. In sample No. 65, the third temperature was too low. Thus, the concentration of Cr contained in cementite was too low, there were many voids, and a sufficient rolling contact fatigue property was not obtained. In sample No. 68, the coiling temperature was too high. Thus, the concentrations of Mn and Cr contained in cementite and the spheroidized ratio of cementite were too low, there were many voids, and a sufficient rolling contact fatigue property was not obtained. In sample No. 69, the fourth temperature was too high. Thus, ferrite and cementite grew excessively. Further, pearlite was formed, and the spheroidized ratio of cementite was low. Consequently, there were many voids, and a sufficient rolling contact fatigue property was not obtained. In sample No. 70, the coiling temperature was too low, the hot-rolled sheet became brittle, and a crack occurred when it is uncoiled for pickling.

In sample No. 72, the coiling temperature was too high. Thus, the concentrations of Mn and Cr contained in cementite and the spheroidized ratio of cementite were too low, there were many voids, and a sufficient rolling contact fatigue property was not obtained. In sample No. 73, the first temperature was too high. Thus, the concentration of Mn contained in cementite was too low, there were many voids, and a sufficient rolling contact fatigue property was not obtained. In sample No. 75, the holding time at the third temperature was too short. Thus, the concentrations of Mn and Cr contained in cementite were too low, there were many voids, and a sufficient rolling contact fatigue property was not obtained. In sample No. 78, the holding time at the first temperature was too short. Thus, the concentrations of Mn and Cr contained in cementite were too low, there were many voids, and a sufficient rolling contact fatigue property was not obtained. In sample No. 79, the second temperature was too high. Thus, pearlite was formed, and the average grain diameter of ferrite was too small. Consequently, there were many voids, and a sufficient rolling contact fatigue property was not obtained. In sample No. 81, the reduction ratio of cold-rolling was too low. Thus, non-recrystallized ferrite existed, uniformity of the structure was low, and a large distortion locally occurred when cold-rolling simulating cold-working was performed. Consequently, many cracks of cementite occurred, there were many voids, and a sufficient rolling contact fatigue property was not obtained. In sample No. 82, the finishing temperature of finish-rolling was too low. Thus, abrasion of the reduction roll was significant, and productivity was low. In sample No. 85, the heating rate from 60° C. to the first temperature was too low, and thus productivity was quite low. In sample No. 87, the heating rate from 60° C. to the first temperature was too high. Thus, the temperature difference between a center portion and a circumferential edge portion of the hot-rolled sheet coil was too large, and scratches due to a thermal expansion difference occurred. In sample No. 88, the coiling temperature was too low, the hot-rolled sheet became brittle, and a crack occurred when it is uncoiled for pickling. In sample No. 92, the heating rate from 60° C. to the third temperature was too high. Thus, the temperature difference between a center portion and a circumferential edge portion of the cold-rolled sheet coil was too large, and scratches due to a thermal expansion difference occurred.

In sample No. 94, the reduction ratio of cold-rolling was too high. Thus, the average grain diameter of ferrite was too small, there were many voids, and a sufficient rolling contact fatigue property was not obtained. In sample No. 95, the second temperature was too low. Thus, cementite is fine after hot-rolled sheet annealing, and the average grain diameter of ferrite was too small. Consequently, there were many voids, and a sufficient rolling contact fatigue property was not obtained. In sample No. 96, the finishing temperature of finish-rolling was too high. Thus, scales occurred excessively during the hot-rolling, and scratches due to the scales occurred. In sample No. 97, the third temperature was too high. Thus, the concentrations of Mn and Cr contained in cementite were too low, there were many voids, and a sufficient rolling contact fatigue property was not obtained. In sample No. 98, the fourth temperature was too low. Thus, the average grain diameter of ferrite was too small, there were many voids, and a sufficient rolling contact fatigue property was not obtained. In sample No. 102, the holding time at the fourth temperature was too short. Thus, the average grain diameter of ferrite was too small, there were many voids, and a sufficient rolling contact fatigue property was not obtained. In sample No. 103, the third temperature was too high. Thus, the concentration of Mn contained in cementite was too low, there were many voids, and a sufficient rolling contact fatigue property was not obtained. In sample No. 111, the third temperature was too low. Thus, the concentration of Cr contained in cementite was too low, there were many voids, and a sufficient rolling contact fatigue property was not obtained. In sample No. 113, the first temperature was too high. Thus, the concentrations of Mn and Cr contained in cementite were too low, there were many voids, and a sufficient rolling contact fatigue property was not obtained.

INDUSTRIAL APPLICABILITY

The present invention can be used in, for example, manufacturing industries and application industries of high-carbon steel sheets used for various steel products, such as drive-line components of automobiles.

The invention claimed is:

1. A high-carbon steel sheet comprising:

a chemical composition represented by, in mass %:

C: 0.60% to 0.90%;
Si: 0.10% to 0.40%;
Mn: 0.30% to 1.50%;
N: 0.0010% to 0.0100%;
Cr: 0.20% to 1.00%;
P: 0.0200% or less;
S: 0.0060% or less;
Al: 0.050% or less;
Mg: 0.000% to 0.010%;
Ca: 0.000% to 0.010%;
Y: 0.000% to 0.010%;
Zr: 0.000% to 0.010%;
La: 0.000% to 0.010%;
Ce: 0.000% to 0.010%; and
balance: Fe and impurities; and a structure represented by:

a concentration of Mn contained in cementite: 2% or more and 8% or less,
a concentration of Cr contained in cementite: 2% or more and 8% or less,
an average grain diameter of ferrite: 10 μm or more and 50 μm or less,
an average particle diameter of cementite: 0.3 μm or more and 1.5 μm or less, and
a spheroidized ratio of cementite: 85% or more.

2. The high-carbon steel sheet according to claim 1, wherein in the chemical composition, Mg: 0.001% to 0.010%,
Ca: 0.001% to 0.010%,
Y: 0.001% to 0.010%,
Zr: 0.001% to 0.010%,
La: 0.001% to 0.010%, or
Ce: 0.001% to 0.010%, or any combination thereof is satisfied.

3. A method of manufacturing a high-carbon steel sheet according to claim 1, comprising:

hot-rolling of a slab to obtain a hot-rolled sheet;
pickling of the hot-rolled sheet;

annealing of the hot-rolled sheet after the pickling to obtain a hot-rolled annealed sheet;

cold-rolling of the hot-rolled annealed sheet to obtain a cold-rolled sheet; and annealing of the cold-rolled sheet, wherein the slab comprises a chemical composition represented by, in mass %:

C: 0.60% to 0.90%;

Si: 0.10% to 0.40%;

Mn: 0.30% to 1.50%;

P: 0.0200% or less;

S: 0.0060% or less;

Al: 0.050% or less;

N: 0.0010% to 0.0100%;

Cr: 0.20% to 1.00%;

Mg: 0.000% to 0.010%;

Ca: 0.000% to 0.010%;

Y: 0.000% to 0.010%;

Zr: 0.000% to 0.010%;

La: 0.000% to 0.010%;

Ce: 0.000% to 0.010%; and balance: Fe and impurities, and in the hot-rolling, a finishing temperature of finish-rolling is 800° C. or more and less than 950° C., and a coiling temperature is 450° C. or more and less than 550° C., a reduction ratio in the cold-rolling is 5% or more and 35% or less, the annealing of the hot-rolled sheet comprises:

heating the hot-rolled sheet to a first temperature of 450° C. or more and 550° C. or less, a heating rate from 60° C. to the first temperature being 30° C./hour or more and 150° C./hour or less;

then holding the hot-rolled sheet at the first temperature for one hour or more and less than 10 hours;

then heating the hot-rolled sheet at a heating rate of 5° C./hour or more and 80° C./hour or less from the first temperature to a second temperature of 670° C. or more and 730° C. or less; and then holding the hot-rolled sheet at the second temperature for 20 hours or more and 200 hours or less, the annealing of the cold-rolled sheet comprises:

heating the cold-rolled sheet to a third temperature of 450° C. or more and 550° C. or less, a heating rate from 60° C. to the third temperature is 30° C./hour or more and 150° C./hour or less;

then holding the cold-rolled sheet at the third temperature for one hour or more and less than 10 hours;

then heating the cold-rolled sheet at a heating rate of 5° C./hour or more and 80° C./hour or less from the third temperature to a fourth temperature of 670° C. or more and 730° C. or less; and then holding the cold-rolled sheet at the fourth temperature for 20 hours or more and 200 hours or less.

4. The method of manufacturing the high-carbon steel sheet according to claim 3, wherein in the chemical composition, Mg: 0.001% to 0.010%, Ca: 0.001% to 0.010%, Y: 0.001% to 0.010%, Zr: 0.001% to 0.010%, La: 0.001% to 0.010%, or Ce: 0.001% to 0.010%, or any combination thereof is satisfied.

* * * * *